US012319529B2

(12) United States Patent
Otsuka et al.

(10) Patent No.: US 12,319,529 B2
(45) Date of Patent: Jun. 3, 2025

(54) MEDIUM CONVEYING APPARATUS TO KEEP SEPARATION ROLLER PRESSED TOWARD FEED ROLLER

(71) Applicant: PFU LIMITED, Kahoku (JP)

(72) Inventors: Shota Otsuka, Kahoku (JP); Tomoyuki Niwata, Kahoku (JP)

(73) Assignee: PFU LIMITED, Kahoku (JP)

( * ) Notice: Subject to any disclaimer, the term of this patent is extended or adjusted under 35 U.S.C. 154(b) by 301 days.

(21) Appl. No.: 17/664,551

(22) Filed: May 23, 2022

(65) Prior Publication Data

US 2023/0014406 A1 Jan. 19, 2023

(30) Foreign Application Priority Data

Jul. 14, 2021 (JP) ..... 2021-116720

(51) Int. Cl.

*B65H 3/52* (2006.01)
*B65H 7/06* (2006.01)
*B65H 7/20* (2006.01)

(52) U.S. Cl.

CPC ..... *B65H 3/5261* (2013.01); *B65H 7/06* (2013.01); *B65H 7/20* (2013.01); *B65H 2403/46* (2013.01); *B65H 2403/51* (2013.01); *B65H 2403/512* (2013.01); *B65H 2403/72* (2013.01); *B65H 2403/732* (2013.01); *B65H 2404/1441* (2013.01); *B65H 2515/34* (2013.01); *B65H 2801/06* (2013.01)

(58) Field of Classification Search

CPC ..... B65H 3/5261; B65H 2403/46; B65H 3/5284; B65H 5/062; B65H 2404/1421; B65H 2404/144

See application file for complete search history.

(56) References Cited

U.S. PATENT DOCUMENTS 6,260,839 B1 7/2001 Araki et al.
2005/0184455 A1* 8/2005 Youn ..... B65H 5/06 271/274

FOREIGN PATENT DOCUMENTS

JP 2000-95372 A 4/2000

* cited by examiner

*Primary Examiner* — Jeremy R Severson
(74) *Attorney, Agent, or Firm* — WOMBLE BOND DICKINSON (US) LLP

(57) ABSTRACT

A medium conveying apparatus includes a feed roller to feed a medium, a separation roller opposed to the feed roller, a motor to generate driving force by being supplied with electric power, a cam member rotated in a first direction by the driving force to press the separation roller toward the feed roller, and a driving force transmitting mechanism between the motor and the cam member, the driving force transmitting mechanism being configured to transmit the driving force from the motor to the cam member and provided such that the cam member keeps pressing the separation roller toward the feed roller without rotating the cam member in a second direction opposite to the first direction even if electric power supply to the motor is shut off.

9 Claims, 20 Drawing Sheets

MEDIUM CONVEYING APPARATUS TO KEEP SEPARATION ROLLER PRESSED TOWARD FEED ROLLER

CROSS-REFERENCE TO RELATED APPLICATIONS

This application is based upon and claims the benefit of priority of prior Japanese Patent Application No. 2021-116720, filed on Jul. 14, 2021, the entire contents of which are incorporated herein by reference.

TECHNICAL FIELD

Embodiments discussed in the present specification relate to medium conveyance.

BACKGROUND

A medium conveying apparatus that images a medium while conveying it, such as a scanner, has the function of separating multiple media with a feed roller and a separation roller. In such a medium conveying apparatus, it is necessary to press the separation roller toward the feed roller appropriately so that media can be favorably separated. Force to press the separation roller toward the feed roller varies, for example, depending on variations among components or the state of wear of the rollers, and thus needs to be adjusted on an apparatus-by-apparatus basis. A conventional medium conveying apparatus adjusts the force to press the separation roller toward the feed roller, using driving force generated by a motor, and controls the motor so that it keeps the separation roller pressed toward the feed roller by the adjusted force.

A paper feeding apparatus disclosed in Japanese Unexamined Patent Publication No. 2000-95372 includes a paper separating mechanism comprising a separation roller and a retard roller with a torque limiter wherein the pressing force between the separation roller and the retard roller can vary by urging the retard roller in the direction toward and away from the separation roller.

SUMMARY

According to some embodiments, a medium conveying apparatus includes a feed roller to feed a medium, a separation roller opposed to the feed roller, a motor to generate driving force by being supplied with electric power, a cam member rotated in a first direction by the driving force to press the separation roller toward the feed roller, and a driving force transmitting mechanism between the motor and the cam member, the driving force transmitting mechanism being configured to transmit the driving force from the motor to the cam member and provided such that the cam member keeps pressing the separation roller toward the feed roller without rotating the cam member in a second direction opposite to the first direction even if electric power supply to the motor is shut off.

DESCRIPTION OF EMBODIMENTS

It is to be understood that both the foregoing general description and the following detailed description are exemplary and explanatory, and are not restrictive of the invention, as claimed.

Hereinafter, a medium conveying apparatus according to an embodiment, will be described with reference to the drawings. However, it should be noted that the technical scope of the invention is not limited to these embodiments, and extends to the inventions described in the claims and their equivalents.

Figure 1:
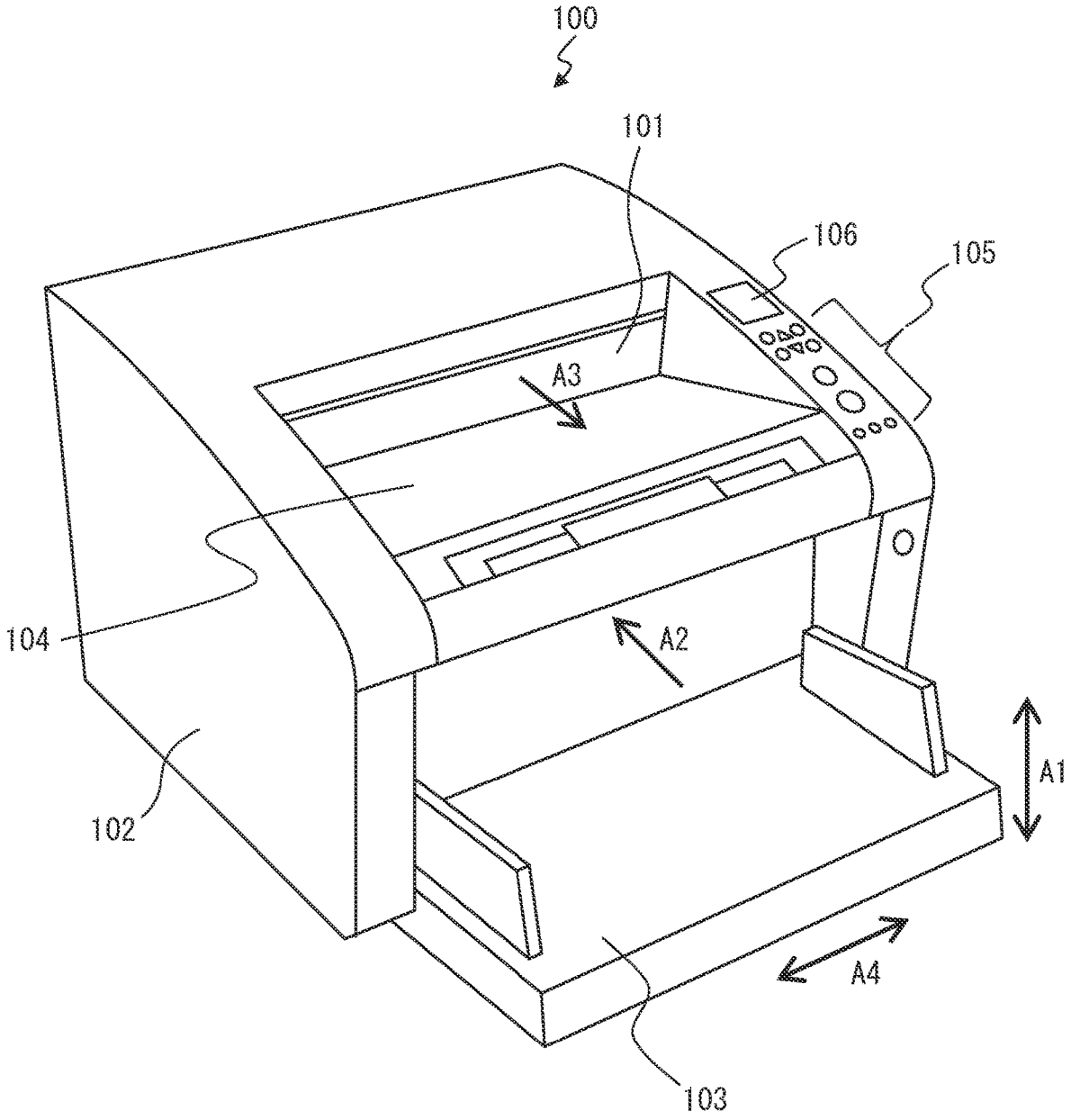
FIG. 1 is a perspective view showing a medium conveying apparatus 100.

FIG. 1 is a perspective view showing a medium conveying apparatus 100 configured as an image scanner. The medium conveying apparatus 100 conveys and images a medium that is a document. The medium is, for example, a sheet of paper, thin paper, or thick paper, or a card. The medium conveying apparatus 100 may be a facsimile machine, a copying machine, or a multifunction peripheral (MIT). The medium to be conveyed may be an object to be printed out rather than a document; and the medium conveying apparatus 100 may be a printer.

The medium conveying apparatus 100 includes a first housing 101, a second housing 102, a medium tray 103, an ejection tray 104, an operation device 105, and a display device 106.

The first housing 101 is located on the upper side of the medium conveying apparatus 100, and engages with the second housing 102 with hinges so as to be openable and closable at the time of a medium jam and cleaning of the inside of the medium conveying apparatus 100.

The medium tray 103 engages with the second housing 102 so that media to be conveyed can be placed thereon. The medium tray 103 is provided on a side surface of medium supply side of the second housing 102, so as to be movable by a motor (not shown) in a substantially vertical direction (height direction) A1. The ejection tray 104 is formed on the first housing 101 so as to be capable of holding an ejected medium, and loads the ejected medium.

The operation device 105 includes an input device, such as buttons, and an interface circuit for acquiring a signal from the input device, accepts operational input by a user, and outputs an operation signal depending on the operational input by the user. The display device 106 includes a liquid crystal or organic electroluminescent (EL) display and an interface circuit for outputting image data to the display, and displays the image data thereon.

In FIG. 1, arrows A2, A3, and A4 indicate a medium conveying direction, a medium ejecting direction, and a width direction perpendicular to the medium conveying direction, respectively. Hereafter, "upstream" refers to upstream as viewed in the medium conveying direction A2 or the medium ejecting direction A3 whereas "downstream" refers to downstream as viewed in the medium conveying direction A2 or the medium ejecting direction A3.

Figure 2:
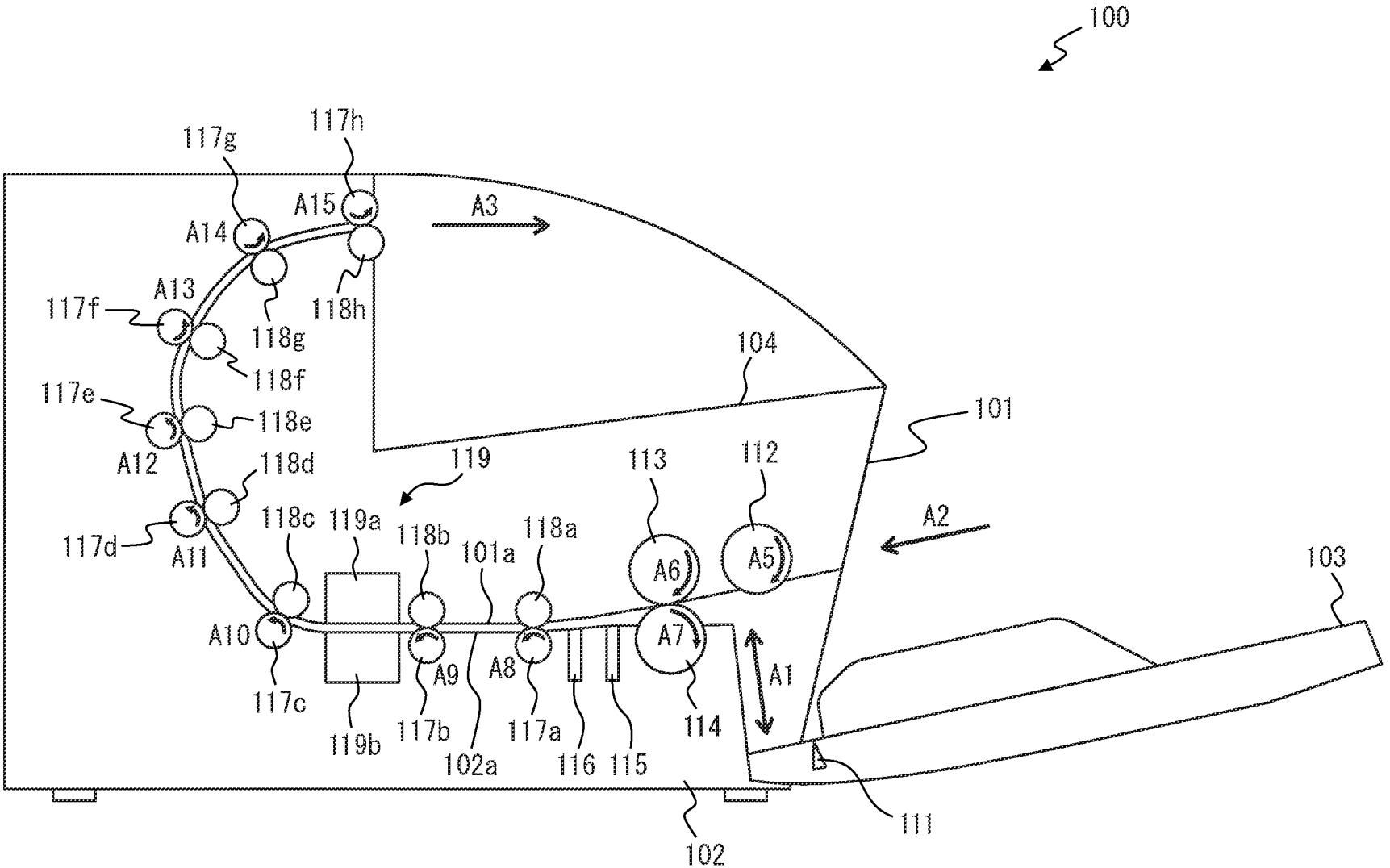
FIG. 2 is a diagram for explaining a conveyance path inside the medium conveying apparatus 100.

FIG. 2 is a diagram for explaining a conveyance path inside the medium conveying apparatus 100.

The medium conveying apparatus 100 includes a first medium sensor 111, a pick roller 112, a feed roller 113, a separation roller 114, a second medium sensor 115, a third medium sensor 116, first to eighth conveyance rollers 117*a* to 117*h*, first to eighth driven rollers 118*a* to 118*h*, and an imaging device 119, on a conveyance path inside the apparatus.

The number of each of the rollers 112, 113, 114, 117*a* to 117*h*, and/or 118*a* to 118*h* is not limited to one, and may be two or more. In this case, multiple pick rollers 112, feed rollers 113, separation rollers 114, first to eighth conveyance rollers 117*a* to 117*h*, and/or first to eighth driven rollers 118*a* to 118*h* are each spaced in the width direction A4.

The surface of the first housing 101 facing the second housing 102 forms a first guide 101*a* of the medium conveyance path whereas the surface of the second housing 102 facing the first housing 101 forms a second guide 102*a* of the medium conveyance path.

The first medium sensor 111 is located on the medium tray 103, i.e., upstream of the feed roller 113 and the separation roller 114, and detects the state of a medium placed on the medium tray 103. The first medium sensor 111 determines whether a medium is placed on the medium tray 103, using a contact sensor that sends a predetermined current when it is in contact or not in contact with a medium. The first medium sensor 111 generates and outputs a first medium signal whose value varies between when a medium is placed on the medium tray 103 and when not. The first medium sensor 111 is not limited to the contact sensor, and may be any other sensor that can detect the presence or absence of a medium, such as an optical sensor.

The pick roller 112 is provided in the first housing 101, and comes into contact with a medium placed on the medium tray 103 and lifted substantially as high as the medium conveyance path, and feeds the medium downstream.

The feed roller 113 is provided in the first housing 101 downstream of the pick roller 112, and feeds a medium placed on the medium tray 103 and fed by the pick roller 112 to downstream. The separation roller 114 is a "brake roller" or "retard roller", and is located in the second housing 102 to face the feed roller 113. The feed roller 113 and the separation roller 114 operate to separate media and feed them one by one. The feed roller 113 is located above the separation roller 114, and the medium conveying apparatus 100 feeds media in "top-first" mode. The feed roller 113 may be located under the separation roller 114, and the apparatus may feed media in "bottom-first" mode.

The second medium sensor 115 is located downstream of the feed roller 113 and the separation roller 114 and upstream of the first conveyance roller 117*a* and the first driven roller 118*a*, i.e., upstream of the imaging device 119, and detects a medium conveyed there. The second medium sensor 115 may be located anywhere in the conveyance path downstream of the feed roller 113 and the separation roller 114. The second medium sensor 115 includes a light emitter and a light receiver provided on one side with respect to the medium conveyance path (e.g., on the side of the second housing 102), and a light guide provided at a position opposing to the light emitter and the light receiver with the medium conveyance path in between (e.g., on the side of the first housing 101). The light emitter is, for example, a light-emitting diode (LED) and emits light toward the medium conveyance path. The light receiver is, for example, a photodiode and receives light emitted by the light emitter and guided by the light guide. When there is a medium facing the second medium sensor 115, the light receiver does not receive light emitted from the light emitter because the light is blocked by the medium, Based on the intensity of received light, the light receiver generates and outputs a second medium signal whose value varies between when there is a medium at the second medium sensor 115 and when not.

The third medium sensor 116 is located downstream of the second medium sensor 115 and upstream of the first conveyance roller 117*a* and the first driven roller 118*a*, i.e., upstream of the imaging device 119, and detects a medium conveyed there. The third medium sensor 116 may be located anywhere in the conveyance path downstream of the second medium sensor 115. The third medium sensor 116 includes a light emitter and a light receiver provided on one side with respect to the medium conveyance path (e.g., on the side of the second housing 102), and a light guide provided at a position opposing to the light emitter and the light receiver with the medium conveyance path in between (e.g., on the side of the first housing 101). The light emitter is, for example, an LED and emits light toward the medium conveyance path. The light receiver is, for example, a photodiode and receives light emitted by the light emitter and guided by the light guide. When there is a medium facing the third medium sensor 116, the light receiver does not receive light emitted from the light emitter because the light is blocked by the medium. Based on the intensity of received light, the light receiver generates and outputs a third medium signal whose value varies between when there is a medium at the third medium sensor 116 and when not.

The second medium sensor 115 and/or the third medium sensor 116 may include a reflecting member, such as a mirror, instead of the light guide. The light emitter and the light receiver of the second medium sensor 115 and/or the third medium sensor 116 may be provided opposite each other with the medium conveyance path in between. The second medium sensor 115 and/or the third medium sensor 116 may detect the presence of a medium, using a contact sensor that sends a predetermined current when it is in contact or not in contact with a medium.

The first to eighth conveyance rollers 117*a* to 117*h* and the first to eighth driven rollers 118*a* to 118*h* are provided downstream of the feed roller 113 and the separation roller 114, and convey a medium fed by the feed roller 113 and the separation roller 114 to downstream.

The imaging device 119 includes a first imaging device 119*a* and a second imaging device 119*b* opposed with the medium conveyance path in between. The first imaging device 119*a* includes a line sensor constructed from a contact image sensor (CIS) of a unit magnification optical system type including imaging elements based on a complementary metal oxide semiconductor (CMOS) and aligned in the main scanning direction. The first imaging device 119*a* also includes lenses that form images on the imaging elements, and an A/D converter that amplifies analog electric signals outputted from the imaging elements and converts them to digital signals. The first imaging device 119*a* images the front side of a medium being conveyed, generates an input image, and outputs it.

Similarly, the second imaging device 119*b* includes a line sensor constructed from a. CIS of a unit magnification optical system type including imaging elements based on a CMOS and aligned in the main scanning direction. The second imaging device 119*b* also includes lenses that form images on the imaging elements, and an A/D converter that amplifies analog electric signals outputted from the imaging elements and converts them to digital signals. The second imaging device 119*b* images the back side of a medium being conveyed, generates an input image, and outputs it.

The medium conveying apparatus 100 may include only the first imaging device 119*a* or the second imaging device 119*b*, and read only one side of a medium. Instead of the line sensor constructed from a CIS of a unit magnification optical system type including imaging elements based on a CMOS, a line sensor constructed from a CIS of a unit magnification optical system type including imaging elements based on charge-coupled devices (CCDs) may be used. Alternatively, a line sensor of a reduction optical system type including imaging elements based on a CMOS or CCDs may be used.

A medium placed on the medium tray 103 is conveyed between the first guide 101*a* and the second guide 102*a* in the medium conveying direction A2 by the pick roller 112 and the feed roller 113 rotating in medium feeding directions A5 and A6, respectively. When multiple media are placed on the medium tray 103, only a medium in contact with the feed roller 113 is separated from the media placed on the medium tray 103 by the separation roller 114 rotating in the direction A7 opposite to the medium feeding direction.

The medium is fed to an imaging position of the imaging device 119 by the first and second conveyance rollers 117*a* and 117*b* rotating in the directions of arrows A8 and A9, respectively, while being guided by the first guide 101*a* and the second guide 102*a*, and is imaged by the imaging device 119. The medium is then ejected on the ejection tray 104 by the third to eighth conveyance rollers 117*c* to 117*h* rotating in the directions of arrows A10 to A15, respectively.

Figure 3:
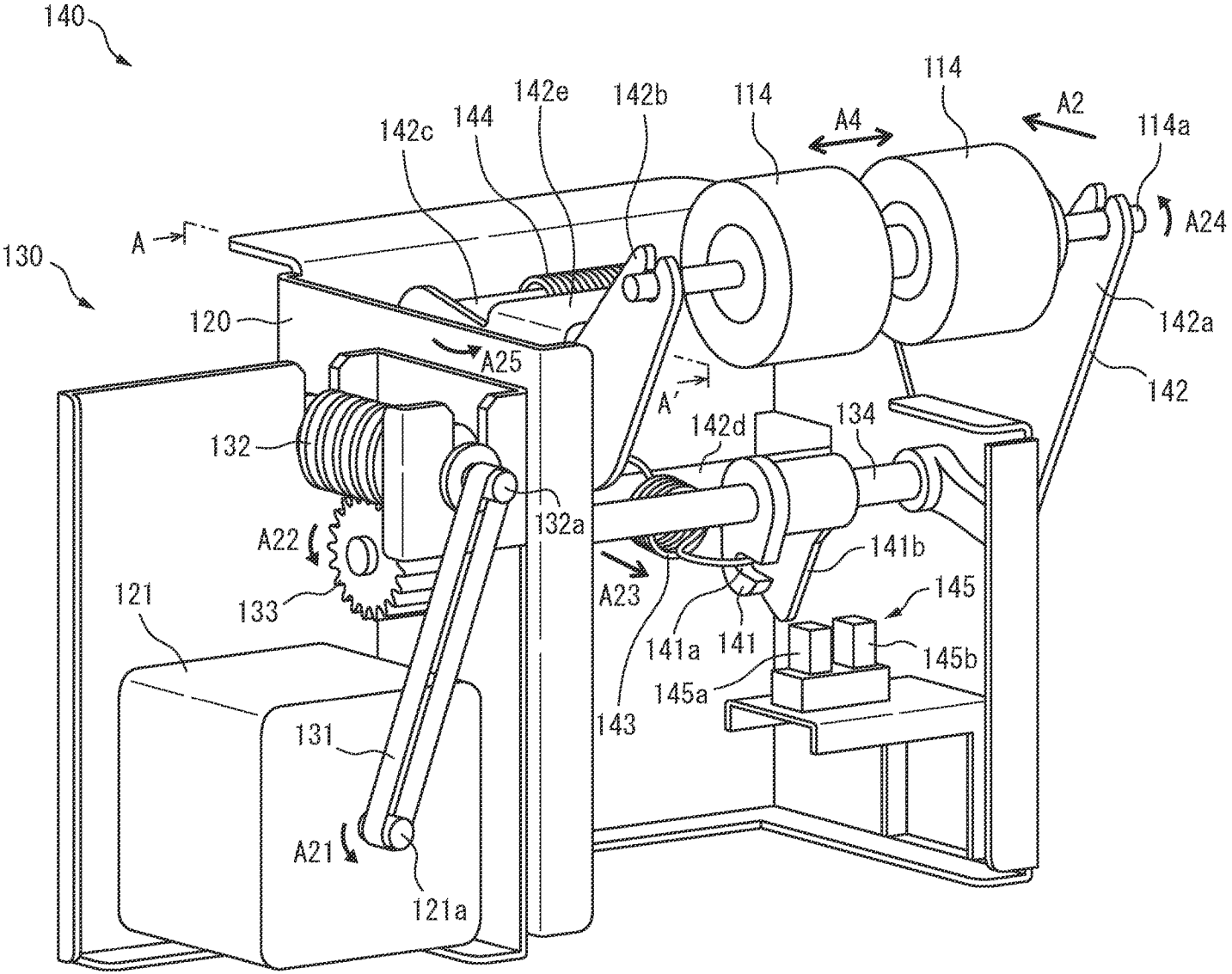
FIG. 3 is a schematic diagram for explaining a driving force transmitting mechanism 130 and other components.

FIG. 3 is a schematic diagram for explaining a driving force transmitting mechanism 130 and a pressing mechanism 140. FIG. 3 is a schematic diagram of the separation roller 114 and its surroundings viewed from upstream.

As shown in FIG. 3, the medium conveying apparatus 100 further includes an inner housing 120, a first motor 121, a driving force transmitting mechanism 130, and a pressing mechanism 140.

The inner housing 120 is located below the separation roller 114 and fixed inside the second housing 102.

The first motor 121, which is an example of the motor, is supplied with electric power according to control by a processing circuit described below to rotate a rotating shaft 121*a*, thereby generating driving force to press the separation roller 114 toward the feed roller 113.

The driving force transmitting mechanism 130 is provided between the first motor 121 and a cam member 141 included in the pressing mechanism 140, and transmits driving force generated by the first motor 121 to the cam member 141. The driving force transmitting mechanism 130 includes a belt 131, a worm 132, a worm wheel 133, and a cam member shaft 134.

The belt 131 is wound around the rotating shaft 121*a* of the first motor 121 and a worm shaft 132*a*, which is the rotating shaft of the worm 132. The worm 132 and the worm wheel 133 constitute a worm gear. The worm 132 is provided to rotate along with the first motor 121 via the belt 131. The worm wheel 133 is provided to mesh with the worm 132 and attached to the cam member shaft 134, The cam member shaft 134, which is the rotating shaft of the cam member 141, is a stick-like member extending in the width direction A4, and is supported by the inner housing 120 so as to rotate along with the worm wheel 133.

Figure 4:
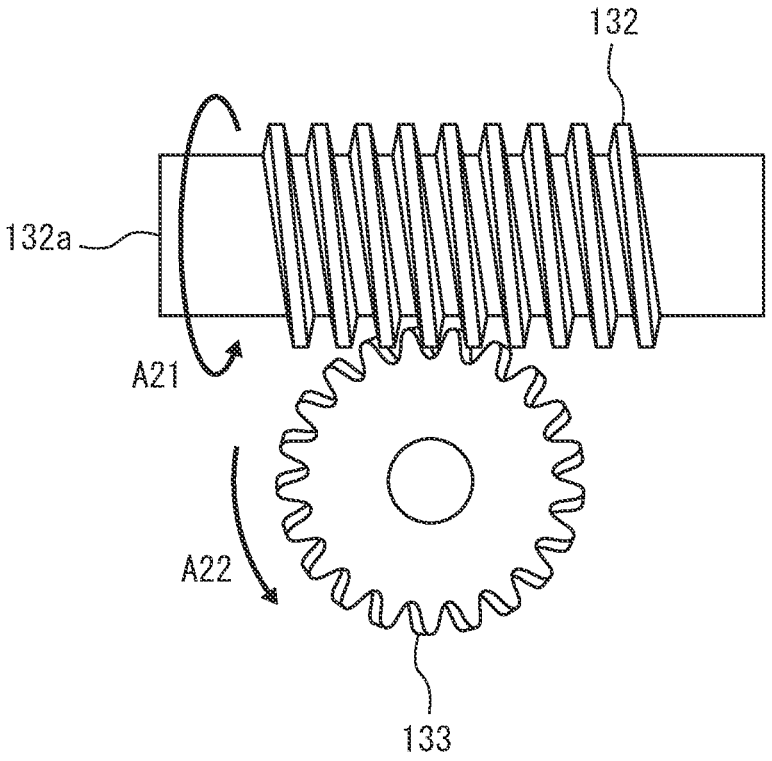
FIG. 4 is a schematic diagram for explaining a worm 132 and a worm wheel 133.

FIG. 4 is a schematic diagram for explaining the worm 132 and the worm wheel 133.

As shown in FIG. 4, the worm 132 is a cylindrical worm, and has a screw-like gear formed on its side surface. The worm wheel 133 has a helical gear meshing with the screw-like gear formed on the side surface of the worm 132. Thus, the worm wheel 133 rotates along with the worm 132. The angle of lead of the groove of the worm 132 is set so that rotation cannot be transmitted from the worm wheel 133 to the worm 132. Thus, the worm 132 is not rotated by rotation of the worm wheel 133.

Figure 5:
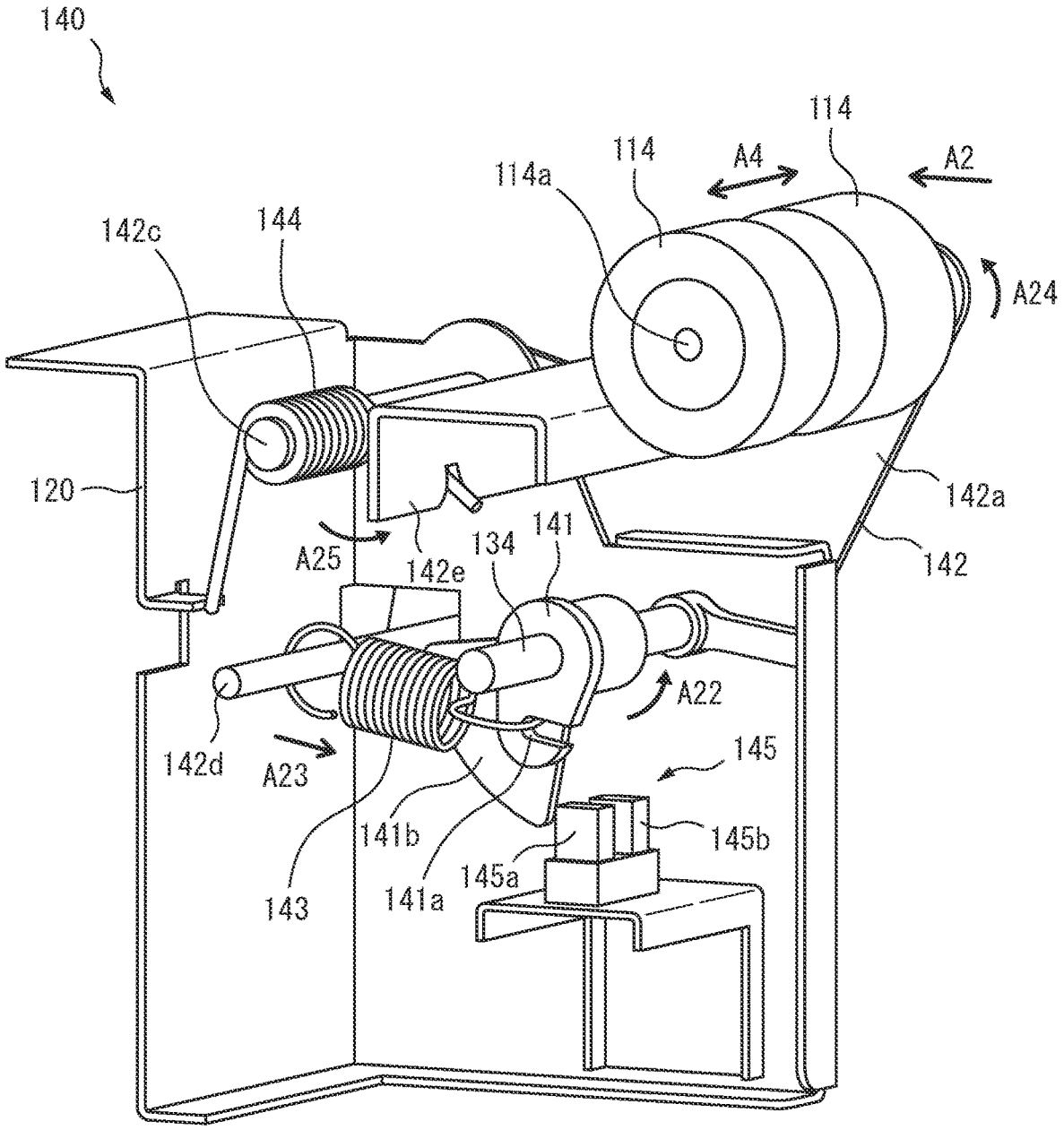
FIG. 5 is a perspective view of a pressing mechanism 140.
Figure 6:
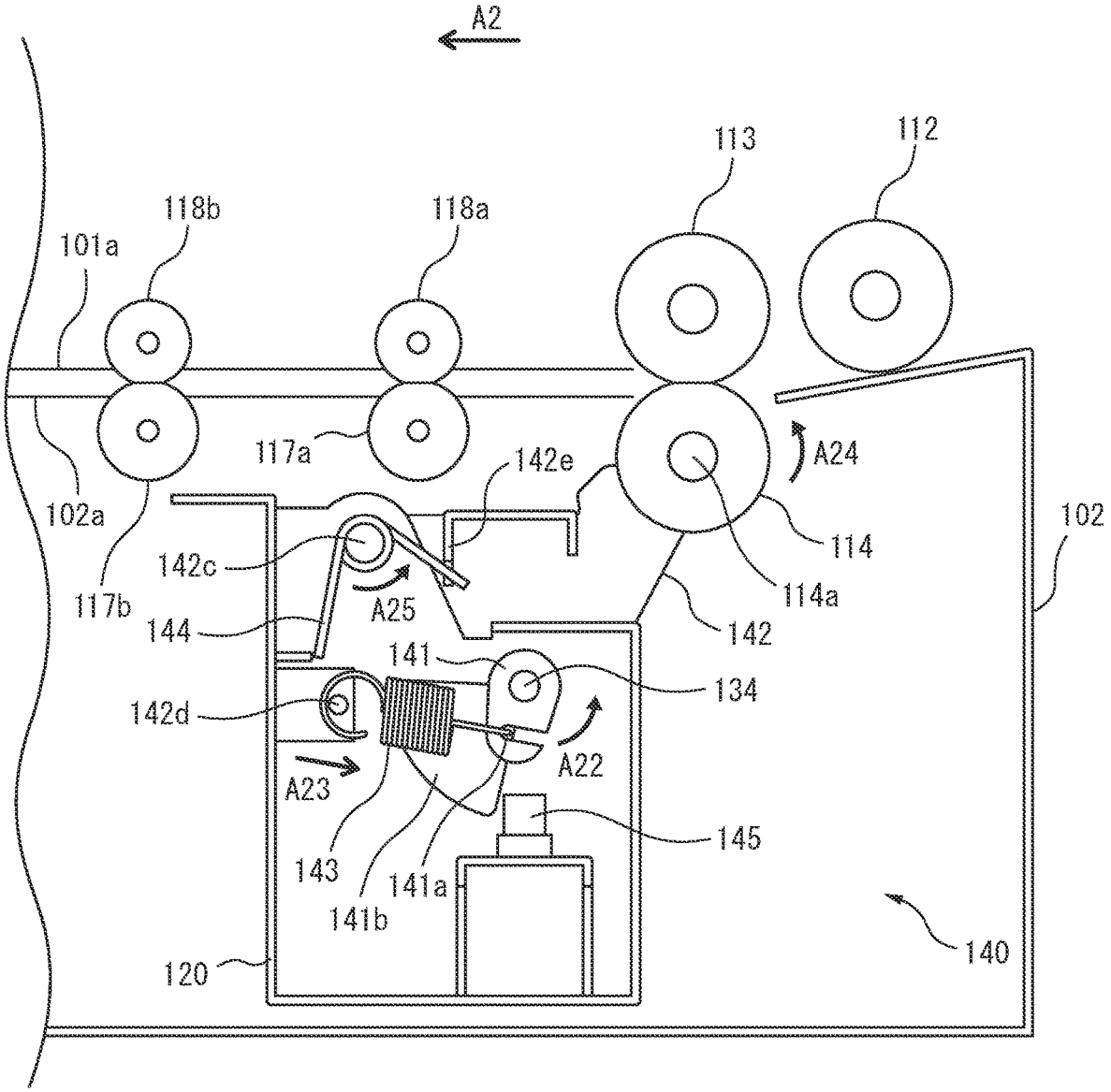
FIG. 6 is a side view of the pressing mechanism 140.
Figure 7:
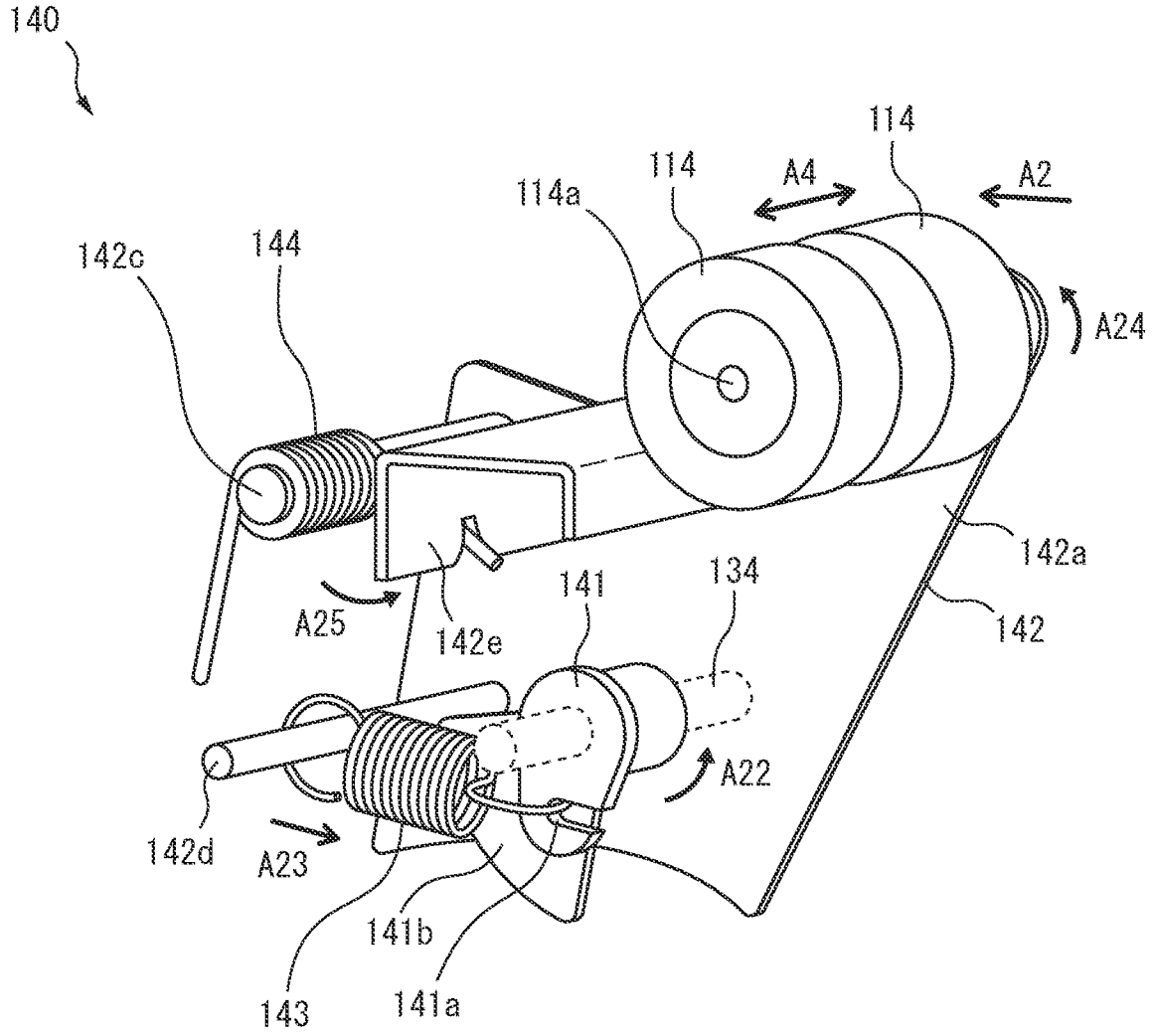
FIG. 7 is a perspective view showing the pressing mechanism 140 removed from an inner housing 120.

FIGS. 5 and 6 are a perspective view and a side view of the pressing mechanism 140 in FIG. 3 cut along line A-A', respectively. In addition to the separation roller 114, FIG. 6 shows the pick roller 112, the feed roller 113, the first and second conveyance rollers 117*a* and 117*b*, and the first and second driven rollers 118*a* and 118*b*. FIG. 7 is a perspective view showing the pressing mechanism 140 removed from the inner housing 120.

As shown in FIGS. 3 and 5 to 7, the pressing mechanism 140 is a mechanism for pressing the separation roller 114 toward the feed roller 113 by driving force generated by the first motor 121 and transmitted by the driving force transmitting mechanism 130. In addition to the cam member 141, the pressing mechanism 140 includes a support member 142, a first elastic member 143, a second elastic member 144, and a cam member sensor 145.

The cam member 141 is attached to the cam member shaft 134 so as to be rotated (swung) by rotation of the cam member shaft 134. The cam member 141 is provided with an engaging portion 141*a* and a detection target portion 141*b*. The engaging portion 141*a* is a recess for attaching the first elastic member 143. The detection target portion 141*b* is a plate-like member rotating (swinging) along with the cam member 141.

The support member 142, which is an example of a support, is swingably supported by the inner housing 120 and supports the separation roller 114. The support member 142 includes a first plate-like member 142*a*, a second plate-like member 142*b*, a support member shaft 142*c*, a first engaging member 142*d*, and a second engaging member 142*e*.

The first plate-like member 142*a* and the second plate-like member 142*b* are separated in the width direction A4 and located side by side to extend in a direction perpendicular to the width direction A4. To each of the upstream and upper edges of the first plate-like member 142*a* and the second plate-like member 142*b* is attached a separation roller shaft 114*a*, which is the rotating shaft of the separation roller 114. To the inner surfaces of the first plate-like member 142*a* and the second plate-like member 142*b* are attached each of the ends in the width direction A4 of the support member shaft 142*c*, the first engaging member 142*d*, and the second engaging member 142*e*.

The support member shaft 142*c*, which is the rockshaft of the support member 142, is a stick-like member extending in the width direction A4. The support member shaft 142*c* is rotatably supported by the inner housing 120, and has ends in the width direction A4 attached to the inner surfaces of the first plate-like member 142*a* and the second plate-like member 142*b*. Thus, the separation roller shaft 114*a* and the separation roller 114 attached to the first plate-like member 142*a* and the second plate-like member 142*b* are supported so as to be swingable relative to the inner housing 120 by rotation of the support member shaft 142*c*.

The first engaging member 142*d* is a stick-like member extending in the width direction A4, and both ends of which in the width direction A4 are attached to the inner surfaces of the first plate-like member 142*a* and the second plate-like member 142*b*.

The second engaging member 142*e* is a stick-like member extending in the width direction A4, and both ends of which in the width direction A4 are attached to the inner surfaces of the first plate-like member 142*a* and the second plate-like member 142*b*.

The first elastic member 143 is, for example, an extension coil spring, and one end of which is attached to the engaging portion 141*a* of the cam member 141, and the other end is attached to the first engaging member 142*d* of the support member 142. The first elastic member 143 is stretched by rotation of the cam member shaft 134 and the cam member 141, applying force toward the upstream side to the first engaging member 142*d*. The first elastic member 143 may be anything that applies force toward the upstream side to the first engaging member 142*d* by rotation of the cam member 141, e.g., a spring other than an extension coil spring, such as a compression coil spring or a leaf spring. The first elastic member 143 may be an elastic member other than a spring, such as rubber.

The second elastic member 144 is, for example, a torsion coil spring, and is attached to the support member shaft 142*c*. One end of the second elastic member 144 is fixed to the inner housing 120 and the other end of the second elastic member 144 is attached to the second engaging member 142*e* of the support member 142, the second elastic member 144 applies upward force to the second engaging member 142*e*. The second elastic member 144 may be anything that applies upward force to the second engaging member 142*e*, e.g., a spring other than a torsion coil spring, such as a compression coil spring or a leaf spring. The second elastic member 144 may be an elastic member other than a spring, such as rubber.

The cam member sensor 145 includes a light emitter 145*a* and a light receiver 145*b*, which are opposed to each other so that the detection target portion 141*b* of the cam member 141 can enter the space therebetween. The light emitter 145*a* is, for example, an LED and emits light toward the light receiver 145*b*. The light receiver 145*b* is, for example, a photodiode and receives light emitted by the light emitter 145*a*. When the detection target portion 141*b* exists between the light emitter 145*a* and the light receiver 145*b*, the light receiver 145*b* does not receive light emitted from the light emitter 145*a* because the light is blocked by the detection target portion 141*b*. Based on the intensity of received light, the light receiver 145*b* generates and outputs a cam member signal whose value varies between when the detection target portion 141*b* exists between the light emitter 145*a* and the light receiver 145*b* and when not.

The following describes operation of the pressing mechanism 140 and the driving force transmitting mechanism 130.

Figure 8:
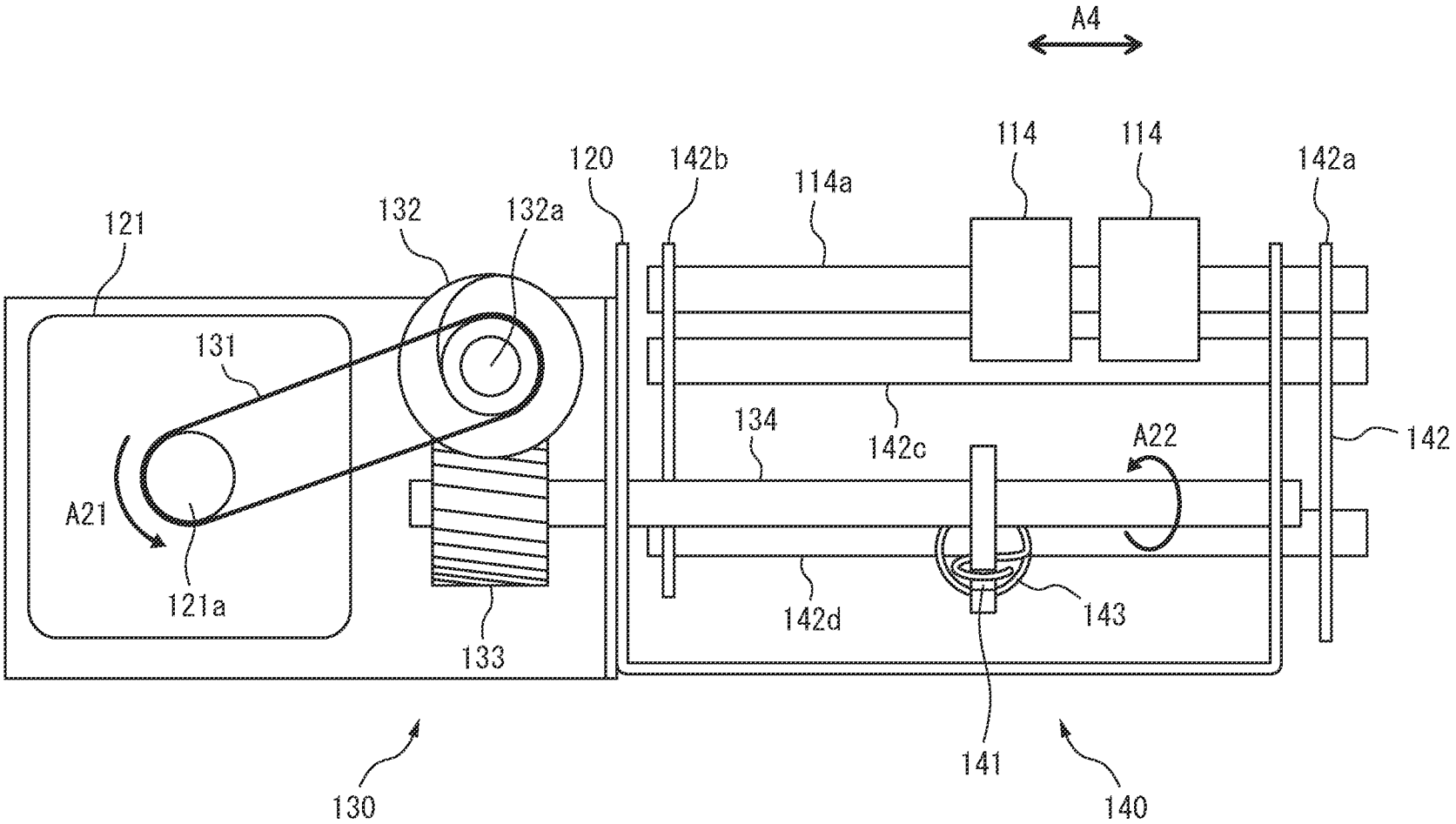
FIG. 8 is a schematic diagram of the driving force transmitting mechanism 130 and the pressing mechanism 140 viewed from upstream.

FIG. 8 is a schematic diagram of the driving force transmitting mechanism 130 and the pressing mechanism 140 viewed from upstream.

As shown in FIG. 8, when the first motor 121 is supplied with electric power and rotates in the direction of arrow A21, the worm 132 rotates in the direction of arrow A21 via the belt 131 and the worm shaft 132*a*. Along with the worm 132, the worm wheel 133 rotates in the direction of arrow A22, causing the cam member 141 to rotate (swing) in the direction of arrow A22 via the cam member shaft 134.

As shown in FIG. 5, rotation (swing) of the cam member 141 in the direction of arrow A22 stretches the first elastic member 143 in the direction of arrow A23 (to the upstream side), which applies force in the direction of arrow A23 to the first engaging member 142*d*. Application of the force in the direction of arrow A23 to the first engaging member 142*d* causes the separation roller 114, which is attached to the upstream and upper edges of the support member 142, to be pressed in the direction of arrow A24 toward the feed roller 113.

In this way, the cam member 141 is rotated in the direction of arrow A22 by driving force generated by the first motor 121 to press the separation roller 114 toward the feed roller 113. The direction of arrow A22 is an example of the first direction.

In addition, the second elastic member 144 applies force in the direction of arrow A25 (upward) to the second engaging member 142*e*. Application of the force in the direction of arrow A25 to the second engaging member 142*e* causes the separation roller 114, which is attached to the upstream and upper edges of the support member 142, to be pressed in the direction of arrow A24 toward the feed roller 113.

As shown in FIG. 8, when the first motor 121 rotates in the direction opposite to arrow A21, the worm 132 rotates in the direction opposite to arrow A21 via the belt 131 and the worm shaft 132*a*. Along with the worm 132, the worm wheel 133 rotates in the direction opposite to arrow A22, causing the cam member 141 to swing in the direction opposite to arrow A22 via the cam member shaft 134.

As shown in FIG. 5, swing of the cam member 141 in the direction opposite to arrow A22 reduces the force in the direction of arrow A23 applied to the first engaging member 142*d* by the first elastic member 143. Because of the reduction of the force in the direction of arrow A23 applied to the first engaging member 142*d*, the force applied to the separation roller 114, which is attached to the upstream and upper edges of the support member 142 and pressing the feed roller 113, is reduced.

In this way, the cam member 141 adjusts the force to press the separation roller 114 toward the feed roller 113 by rotating in the direction of arrow A22 or opposite direction of arrow A22. The direction opposite to arrow A22 is an example of the second direction opposite to the first direction.

As shown in FIG. 5, the cam member 141 stretches the first elastic member 143 in the direction of arrow A23, and conversely, the force in the direction opposite to arrow A23 is applied to the cam member 141 and the cam member shaft 134 by the first engaging member 142*d*. However, rotation of the worm wheel 133 is not transmitted to the worm 132, as described above. Thus, the cam member 141 keeps pressing the separation roller 114 pressed toward the feed roller 113 without the cam member 141 and the cam member shaft 134 rotating in the direction opposite to arrow A22 even if electric power supply to the first motor 121 is shut off.

In this way, the worm 132 and the worm wheel 133 are provided such that the cam member 141 keeps pressing the separation roller 114 toward the feed roller 113 without rotating the cam member 141 in the direction opposite to arrow A22 even if electric power supply to the first motor 121 is shut off. Thus, after setting the separation roller 114 by controlling the first motor 121, the medium conveying apparatus 100 can shut off electric power supply to the first motor 121, enabling reduction in power consumption.

Figure 9:
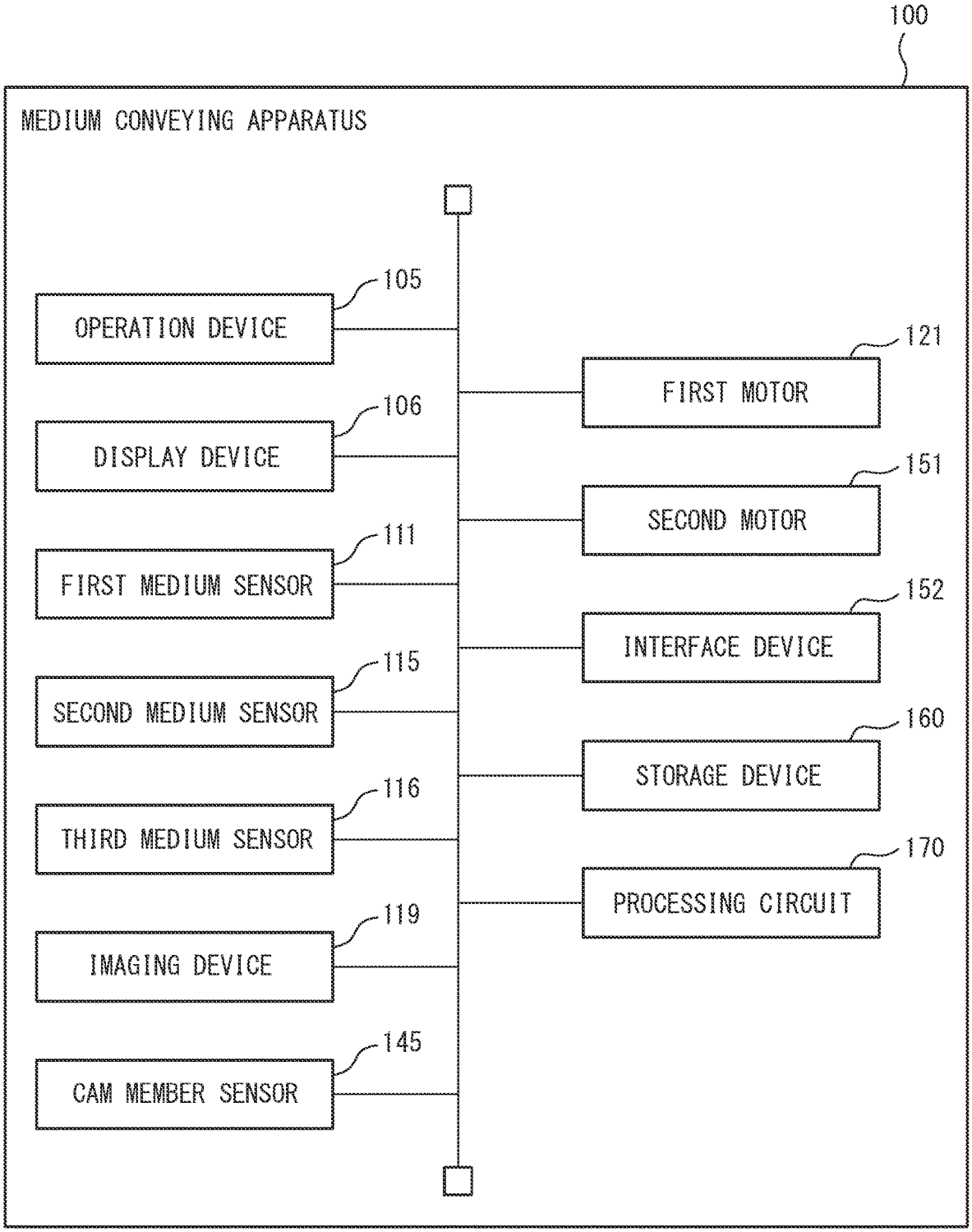
FIG. 9 is a block diagram schematically showing the configuration of the medium conveying apparatus 100.

FIG. 9 is a block diagram schematically showing the configuration of the medium conveying apparatus 100.

In addition to the components described above, the medium conveying apparatus 100 further includes a second motor 151, an interface device 152, storage device 160, and a processing circuit 170.

The second motor 151 includes one or more motors, and rotates the pick roller 112, the feed roller 113, the separation roller 114, and the first to eighth conveyance rollers 117*a* to 117*h* according to control signals from the processing circuit 170 to feed and convey a medium. The first to eighth driven rollers 118*a* to 118*h* may be provided to rotate by driving force from the second motor 151 rather than to be driven to rotate by rotation of the first to eighth conveyance rollers 117*a* to 117*k* In addition, the second motor 151 moves the medium tray 103 according to a control signal from the processing circuit 170.

The interface device 152 includes an interface circuit, for example, conforming to a serial bus, such as a USB, and is electrically connected to an information processor (not shown), such as a personal computer or a personal digital assistant, to transmit and receive a read image and various types of information. Instead of the interface device 152, a communication module may be used that includes an antenna transmitting and receiving wireless signals, and a wireless communication interface circuit for transmitting and receiving signals through a wireless communication channel in accordance with a predetermined communication protocol. The predetermined communication protocol is, for example, a wireless local area network (LAN).

The storage device 160 includes a memory device, such as a random access memory (RAM) or a read-only memory (ROM); a fixed disk device, such as a hard disk; or a portable storage device, such as a flexible disk or an optical disk. The storage device 160 contains computer programs, databases, and tables used for various processes of the medium conveying apparatus 100. The computer programs may be installed on the storage device 160 from a computer-readable, non-transitory portable storage medium by using a well-known set-up program, etc. The portable storage medium is, for example, a compact disc read-only memory (CD-ROM) or a digital versatile disc read-only memory (DVD-ROM).

The processing circuit 170 operates in accordance with a program prestored in the storage device 160. The processing circuit 170 is, for example, a central processing unit (CPU). As the processing circuit 170 may be used a digital signal processor (DSP), a large-scale integration (LSI), an application specific integrated circuit (ASIC), or a field-programmable gate array (FPGA).

The processing circuit 170 is connected to the operation device 105, the display device 106, the first, second, and third medium sensors 111, 115, and 116, the imaging device 119, the cam member sensor 145, the first motor 121, the second motor 151, the interface device 152, and the storage device 160, and controls them. The processing circuit 170 controls the second motor 151 to convey a medium, controls the imaging device 119 to acquire an input image, and transmits the acquired input image to an information processing apparatus via the interface device 152. In addition, the processing circuit 170 controls the first motor 121 to press the separation roller 114 toward the feed roller 113.

Figure 10:
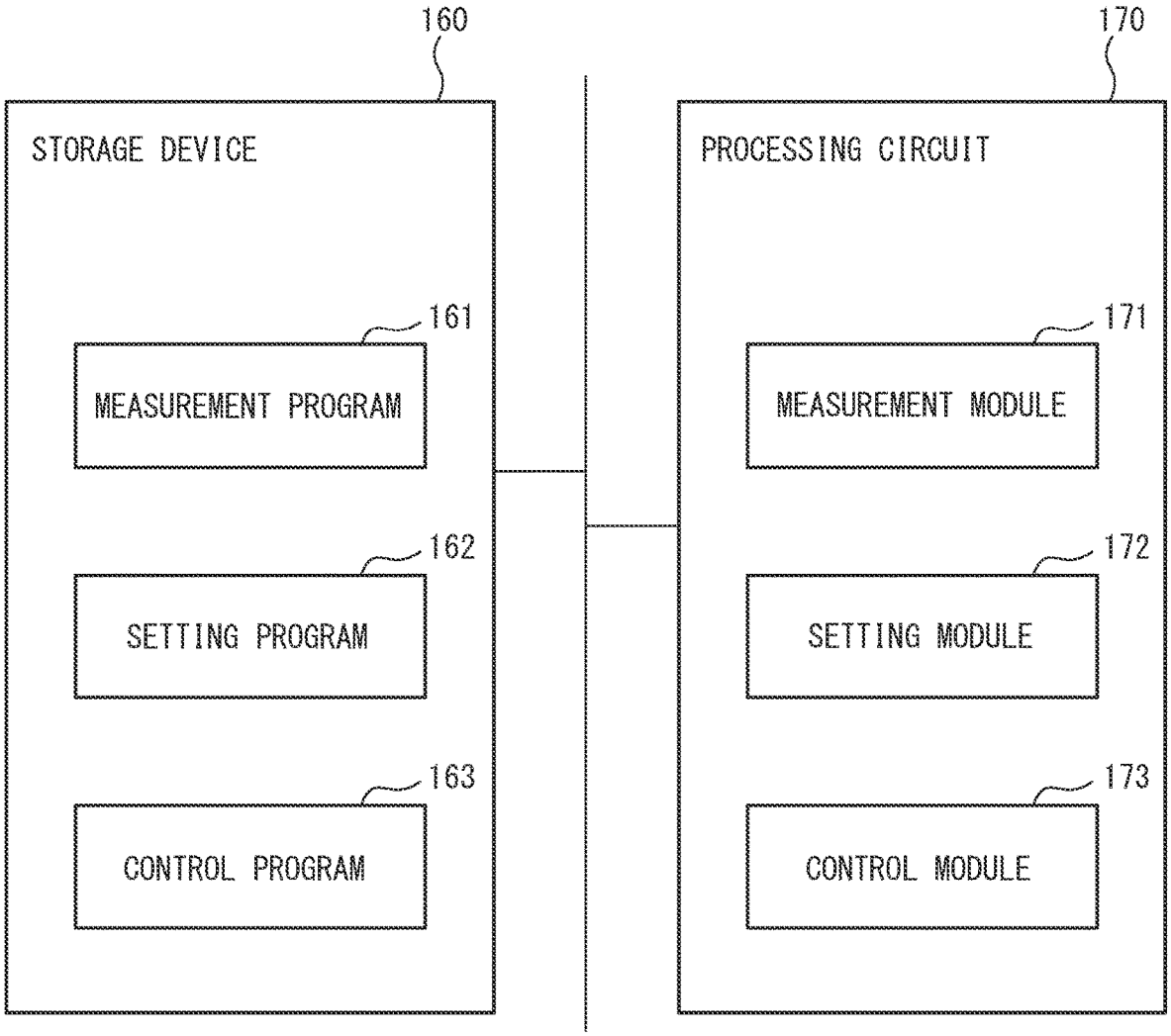
FIG. 10 schematically shows the configuration of a storage device 160 and a processing circuit 170.

FIG. 10 schematically shows the configuration of the storage device 160 and the processing circuit 170.

As shown in FIG. 10, the storage device 160 contains programs such as a measurement program 161, a setting program 162, and a control program 163. These programs are functional modules implemented by software executed by a processor. The processing circuit 170 reads the programs stored in the storage device 160 and operates in accordance with the read programs, functioning as a measurement module 171, a setting module 172, and a control module 173.

Figure 11:
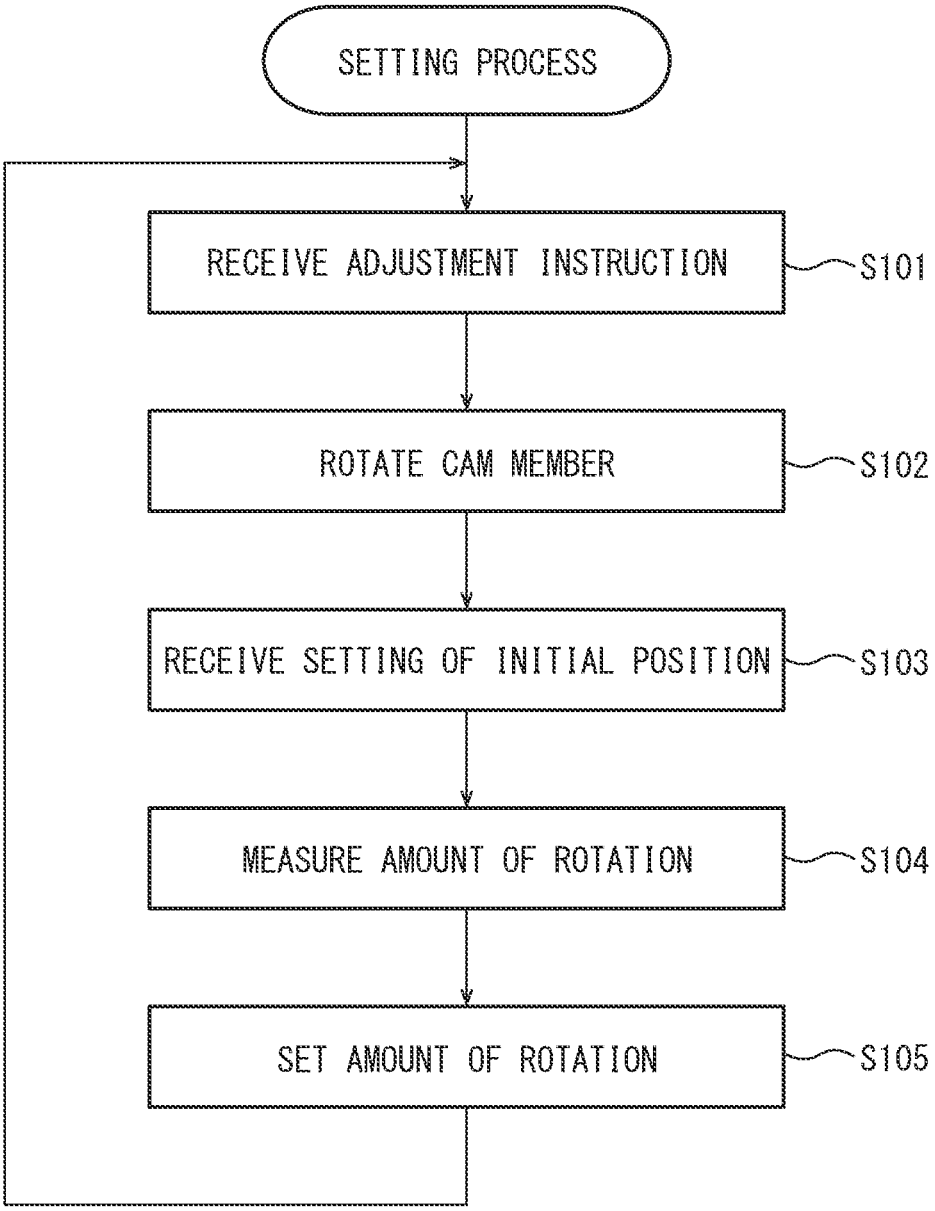
FIG. 11 is a flowchart showing an example of operation of a setting process.

FIG. 11 is a flowchart showing an example of operation of a setting process.

With reference to the flowchart shown in FIG. 11, an example of operation of a setting process by, the medium conveying apparatus 100 will be described below. The operation flow described below is executed mainly by the processing circuit 170 in accordance with a program prestored in the storage device 160 in cooperation with the components of the medium conveying apparatus 100. The setting process is executed before shipment of the apparatus, for example, at a factory by an operator. When the setting process is executed, the first housing 101 is opened, and a measuring instrument to measure pressing force of the separation roller 114 is located to face the separation roller 114, instead of the feed roller 113.

First, the measurement module 171 stands by until it accepts an instruction to adjust the cam member 141 by the operator (step S101). The measurement module 171 accepts the instruction to adjust the cam member 141, which is inputted with the operation device 105 or an information processing apparatus, when receiving an adjustment signal of the instruction to adjust the cam member 141 from the operation device 105 or the interface device 152.

When accepting the instruction to adjust the cam member 141, the measurement module 171 drives the first motor 121 to rotate the cam member 141 (step S102).

The measurement module 171 first causes the cam member 141 to be located at an unopposed position where the detection target portion 141*b* is not opposed to the cam member sensor 145. The measurement module 171 rotates the cam member 141 in the direction opposite to arrow A22 in FIG. 5 (direction such that the separation roller 114 moves downward) by a predetermined amount and receives a cam member signal from the cam member sensor 145 at regular intervals. When the value of the received cam member signal indicates that, the detection target portion 141*b* does not exist between the light emitter 145*a* and the light receiver 145*b*, the measurement module 171 determines that the cam member 141 is located at an unopposed position.

The measurement module 171 then rotates the cam member 141 in the direction of arrow A22 in FIG. 5 (direction such that the separation roller 114 moves upward) by a predetermined amount and receives a cam member signal from the cam member sensor 145 at regular intervals. When the received cam member signal changes from a value indicating that the detection target portion 141*b* does not exist between the light emitter 145*a* and the light receiver 145*b* to a value indicating that it exists therebetween, the measurement module 171 determines that the cam member 141 is located at a reference position. The measurement module 171 keeps measuring the driving amount of the first motor 121 after the cam member 141 is located at the reference position.

The measurement module 171 then stands by until it accepts setting of the initial position of the cam member 141 by the operator (step S103). The measurement module 171 accepts the setting of the initial position of the cam member 141, which is inputted with the operation device 105 or the information processing apparatus, when receiving a setting signal for setting the initial position of the cam member 141 from the operation device 105 or the interface device 152. The operator monitors the measuring instrument located to face the separation roller 114, and when the pressing force of the separation roller 114 reaches the magnitude satisfying the specification of the apparatus, sets the current position of the cam member 141 as the initial position.

When accepting the setting of the initial position of the cam member 141, the measurement module 171 stops the first motor 121 to stop rotating the cam member 141, and measures the amount of rotation of the cam member 141 (step S104). The measurement module 171 measures the driving amount of the first motor 121 after the cam member 141 is located at the reference position as the amount of rotation of the cam member 141 from the reference position.

The setting module 172 then sets a value based on the amount of rotation, which is measured by the measurement module 171 when the setting of the initial position of the cam member 141 by the operator is accepted, in the storage device 160 as a default value (step S105), and returns the process to step S101. For example, the setting module 172 sets the amount of rotation itself measured in step S104 as the default value. The setting module 172 may set the physical position or angle of the cam member 141 corresponding to the amount of rotation measured in step S104 as the default value.

Even if the driving amount of the first motor 121 is identical, the pressing force for the separation roller 114 to press the feed roller 113 may vary among multiple medium conveying apparatuses 100, for example, because of variations in the characteristics of the elastic members and the position where the cam member 141 is initially located, Each medium conveying apparatus 100 sets a value based on the amount of rotation of the cam member 141 from the reference position as the default value. This enables the medium conveying apparatuses 100 to include respective separation rollers 114 located at positions where the pressing force is identical, regardless of variations in the characteristics of the elastic members and the position where the cam member 141 is initially located.

The measurement module 171 may use a sensor of a type different from that of the cam member sensor 145 to measure the amount of rotation of the cam member 141. For example, the measurement module 171 may use a contact sensor that sends a predetermined current when it is in contact or not in contact with the cam member 141 to determine whether the cam member 141 is located at the reference position. Alternatively, the detection target portion 141*b* may have a large number of slits (holes to transmit light). In this case, the measurement module 171 can measure the amount of rotation of the cam member 141 from the reference position, based on the number of times of changes between the state in which there is a slit between the light emitter 145*a* and the light receiver 145*b* and the state in which there is no slit therebetween and blocked by the detection target portion 141*b*.

As described above, the pressing force of the separation roller 114 may vary among multiple medium conveying apparatuses 100 because of variations in the characteristics of the elastic members and the position of the cam member 141. In particular, variations in the position of the cam member 141 greatly affect the pressing force of the separation roller 114, and only a slight change in the position of the cam member 141 leads to a considerable change in the pressing force of the separation roller 114.

In the medium conveying apparatus 100, the two elastic members, i.e., the first elastic member 143 having an end fixed to the cam member 141 and the second elastic member 144 having an end fixed to the inner housing 120, apply force to the support member 142 to support the separation roller 114. The second elastic member 144 applies constant force to the support member 142 regardless of the driving amount of the first motor 121 whereas the first elastic member 143 applies force depending on the driving amount of the first motor 121 to the support member 142. In the medium conveying apparatus 100, the use of a spring having a sufficiently larger spring constant than the first elastic member 143 as the second elastic member 144 enables the second elastic member 144 to generate most of the force applied to the support member 142. This lowers the ratio of the force applied by the first elastic member 143 to the force applied to the support member 142, and reduces the effect of variations in the position of the cam member 141 to the pressing force of the separation roller 114. Thus, the medium conveying apparatus 100 can reduce fluctuations in the pressing force of the separation roller 114 caused by variations in the amount of movement of the cam member 141 and separate media with reliability, using the second elastic member 144 and the first elastic member 143.

Figure 12:
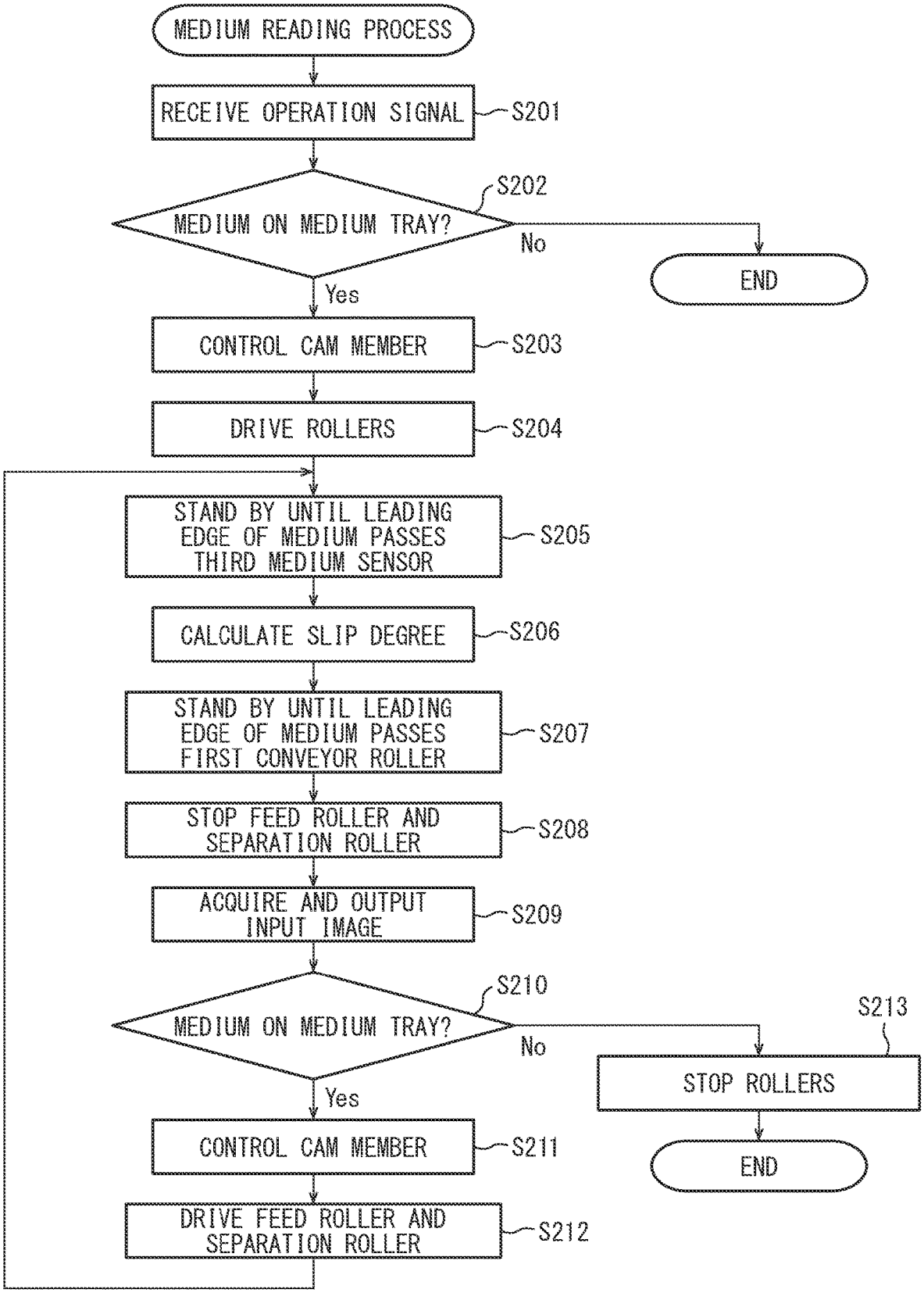
FIG. 12 is a flowchart showing an example of operation of a medium reading process.

FIG. 12 is a flowchart showing an example of operation of a medium reading process.

With reference to the flowchart shown in FIG. 12, an example of operation of a medium reading process by the medium conveying apparatus 100 will be described below. The operation flow described below is executed mainly by the processing circuit 170 in accordance with a program prestored in the storage device 160 in cooperation with the components of the medium conveying apparatus 100.

First, the control module 173 stands by until it receives an operation signal of an instruction to read a medium from the operation device 105 or the interface device 152 in response to a user inputting the reading instruction with the operation device 105 or the information processing apparatus (step S201).

The control module 173 then acquires a first medium signal from the first medium sensor 111, and determines whether a medium is placed on the medium tray 103, based on the acquired first medium signal (step S202). When no medium is placed on the medium tray 103, the control module 173 terminates the sequence of steps.

When a medium is placed on the medium tray 103, the control module 173 drives the first motor 121 according to the default value set in the storage device 160 to rotate the cam member 141, causing the cam member 141 to be located at the initial position (step S203). Similarly to the processing of step S102, the control module 173 rotates the cam member 141, and drives the first motor 121 by an amount corresponding to the default value after the cam member 141 passes the reference position, causing the cam member 141 to be located at the initial position. In this way, the pressing force of the separation roller 114 is set at the magnitude satisfying the specification of the apparatus.

The control module 173 then drives the second motor 151 to move the medium tray 103 to a position where the medium comes into contact with the pick roller 112. The control module 173 drives the second motor 151 to rotate the pick roller 112, the feed roller 113, the separation roller 114, and the first to eighth conveyance rollers 117*a* to 117*h*, causing the medium placed on the medium tray 103 to be fed and conveyed (step S204).

The control module 173 then stands by until the leading edge of the medium passes the third medium sensor 116 (step S205). The control module 173 regularly receives a third medium signal from the third medium sensor 116, and determines that the leading edge of the medium has passed the third medium sensor 116, when the third medium signal changes from a value indicating the absence of a medium to a value indicating the presence of a medium.

The control module 173 then calculates the degree of slipping that has occurred between the medium and the feed roller 113 from when the leading edge of the medium passes the second medium sensor 115 until it passes the third medium sensor 116, as a slip degree. The control module 173 stores the calculated slip degree in the storage device 160 (step S206).

The control module 173 acquires the driving amount by which the motor drives the feed roller 113 from when the leading edge of the medium passes the second medium sensor 115 until it passes the third medium sensor 116. The control module 173 regularly acquires a second medium signal and a third medium signal from the second medium sensor 115 and the third medium sensor 116, and detects the timings at which the leading edge of the medium passes the second medium sensor 115 and the third medium sensor 116. The control module 173 acquires the number of pulses of a pulse signal supplied to the second motor 151 to rotate the feed roller 113 from when the leading edge of the medium passes the second medium sensor 115 until it passes the third medium sensor 116 as the driving amount.

For example, the control module 173 calculates the slip degree S in accordance with the following expression (1).

$$S=(T1/T2-1)\times 100 \quad (1)$$

where T1 is the conveying distance of the medium conveyed by the feed roller 113 from when the leading edge of the medium passes the second medium sensor 115 until it passes the third medium sensor 116. T1 is calculated by multiplying the acquired driving amount by the conveying distance by the feed roller 113 per pulse. T2 is the distance between the second medium sensor 115 and the third medium sensor 116. In other words, the slip degree increases with the degree of slipping of the medium by the feed roller 113.

The control module 173 then stands by until the leading edge of the medium passes the first conveyance roller 117*a* (step S207). The control module 173 determines that the leading edge of the medium has passed the first conveyance roller 117*a*, when a predetermined period of time has elapsed since the determination in step S205 that the leading edge of the medium has passed the third medium sensor 116. The predetermined period is set at the sum of the time required for a medium to move from the third medium sensor 116 to the first conveyance roller 117*a* and a margin.

The control module 173 then controls the second motor 151 to stop the pick roller 112, the feed roller 113, and the separation roller 114 (step S208). Thereafter, the medium is conveyed by the first conveyance roller 117*a*, and the pick roller 112, the feed roller 113, and the separation roller 114 are driven to rotate by the medium being conveyed.

The control module 173 then causes the imaging device 119 to image the medium, acquires an input image from the imaging device 119, and transmits the acquired input image to the information processing apparatus via the interface device 152 to output it (step S209).

The control module 173 then determines whether a medium remains on the medium tray 103, based on a first medium signal received from the first medium sensor 111 (step S210).

When a medium remains on the medium tray 103, the control module 173 drives the first motor 121 according to the slip degree stored in the storage device 160 to rotate the cam member 141, thereby varying the pressing force of the separation roller 114 (step S211). The medium conveying apparatus 100 prestores a table indicating the relationship between the slip degree and the position where the cam member 141 is located (the driving amount of the first motor 121 to locate the cam member at this position) in the storage device 160. The position where the cam member 141 is located is set so that the pressing force of the separation roller 114 increases with the slip degree. The control module 173 refers to the table to determine the driving amount of the first motor 121 corresponding to the slip degree stored in the storage device 160. Similarly to the processing of step S203, the control module 173 rotates the cam member 141, and drives the first motor 121 by the determined driving amount after the cam member 141 passes the reference position, causing the cam member 141 to be located at the position depending on the slip degree. In this way, the control module 173 can prevent the occurrence of a slip of a medium by increasing the pressing force of the separation roller 114 if the degree of slipping of a medium is increased by the wear of the feed roller 113.

The control module 173 may calculate a statistical value, such as the average, median, minimum, or maximum of a predetermined number of recent slip degrees, and determine the driving amount of the first motor 121 corresponding to the calculated statistical value. In this way, the control module 173 can prevent frequent movement of the cam member 141 caused by a particular medium that is likely to slip, and cause a medium to be conveyed stably.

The control module 173 then controls the second motor 151 to rotate the pick roller 112, the feed roller 113, and the separation roller 114 again (step S212), proceeds to the processing of step S205, and repeats the processing of steps S205 to S210.

When no medium remains on the medium tray 103, the control module 173 stops the second motor 151 to stop the first to eighth conveyance rollers 117*a* to 117*h* (step S213), and terminates the sequence of steps.

As described above in detail, the medium conveying apparatus 100 includes the driving force transmitting mechanism 130 that transmits driving force from the first motor 121 to the cam member 141 for pressing the separation roller 114 toward the feed roller 113. The driving force transmitting mechanism 130 prevents the cam member 141 from rotating in the backward direction without sending a hold current for stopping the cam member 141 to the first motor 121. This enables the medium conveying apparatus 100 to keep pressing the separation roller 114 toward the feed roller 113 with appropriate force while reducing power consumption.

Figure 13:
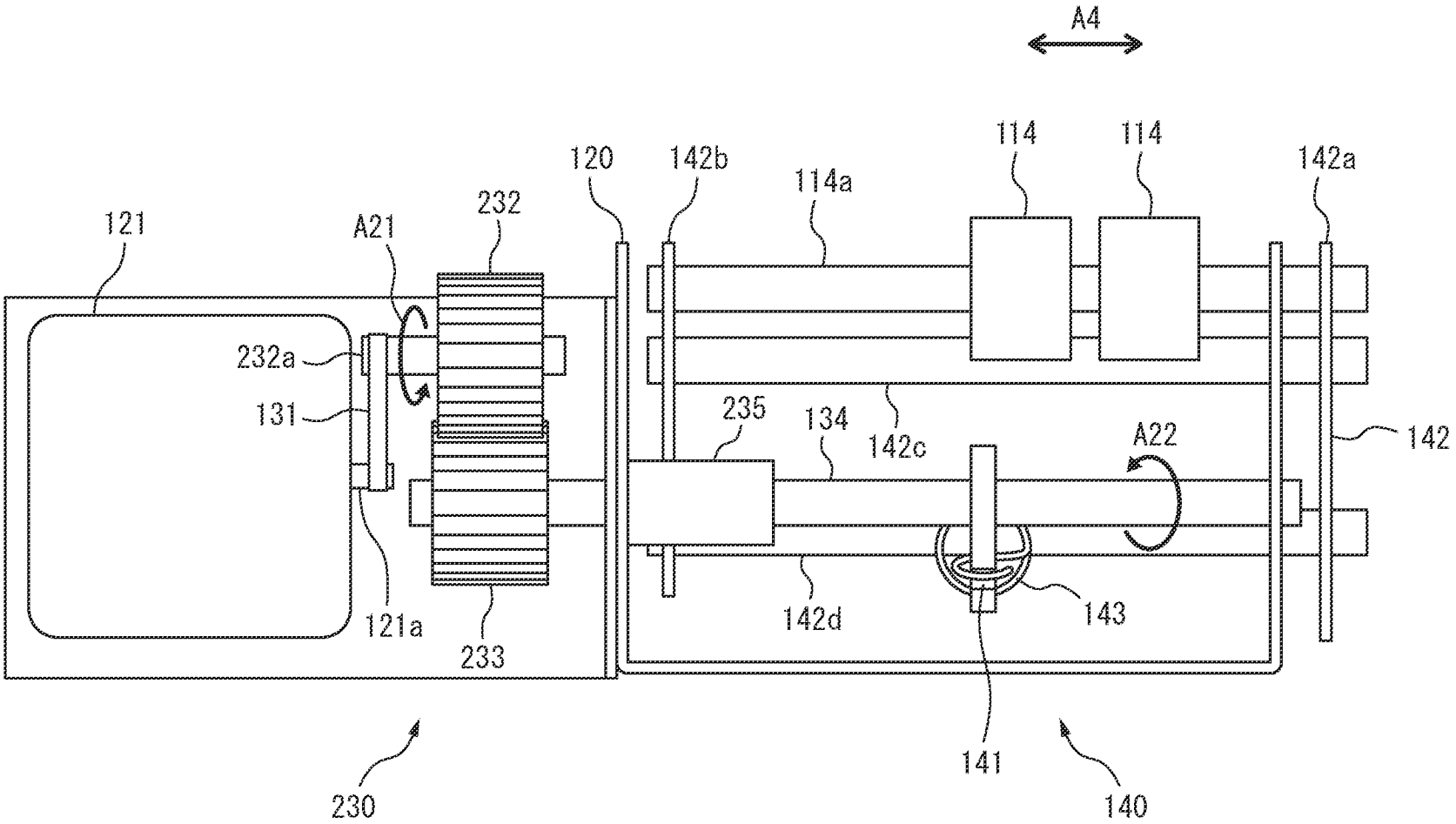
FIG. 13 is a schematic diagram for explaining a driving force transmitting mechanism 230.

In addition, the medium conveying apparatus 100 enables separating force of the separation roller 114 to be set appropriately without an expensive component that can switch torque applied to the separation roller 114, such as an electromagnetic clutch, enabling reduction in the apparatus cost, FIG. 13 is a schematic diagram for explaining another driving force transmitting mechanism 230. FIG. 13 is a schematic diagram of the driving force transmitting mechanism 230 and the pressing mechanism 140 viewed from upstream.

The driving force transmitting mechanism 230, which is used instead of the driving force transmitting mechanism 130, has a structure and a mechanism similar to those of the driving force transmitting mechanism 130. However, the driving force transmitting mechanism 230 does not include the worm 132 nor the worm wheel 133, and instead includes a first gear 232, a second gear 233, and a torque limiter 235.

The belt 131 is wound around the rotating shaft 121*a* of the first motor 121 and a first gear shaft 232*a*, which is the rotating shaft of the first gear 232. The first gear 232 is provided to mesh with the second gear 233. The second gear 233 is attached to the cam member shaft 134.

The torque limiter 235 is provided to prevent rotation of the cam member shaft 134 until torque greater than a limit value is applied to the cam member shaft 134. The limit value of the torque limiter 235 is set greater than that force to attempt to rotate the cam member 141 in the direction opposite to arrow A22 which is caused by the tensile force of the first elastic member 143 and the weight of the separation roller 114. The first motor 121 rotates the cam member shaft 134 via the belt 131, the first gear 232, and the second gear 233 so that torque greater than the limit value is applied to the torque limiter 235. Since torque applied to the torque limiter 235 to attempt to rotate the cam member 141 in the direction opposite to arrow A22 is less than the limit value, rotation of the cam member shaft 134 by the tensile force of the first elastic member 143 and the weight of the separation roller 114 is prevented.

More specifically, the torque limiter 235 transmits driving force generated by the first motor 121 from the first motor 121 to the cam member 141, rotating the cam member 141 to press the separation roller 114 toward the feed roller 113. The torque limiter 235 is provided so that the cam member 141 keeps pressing the separation roller 114 toward the feed roller 113 without rotating the cam member 141 in the direction opposite to arrow A22 even if electric power supply to the first motor 121 is shut off. Thus, after controlling the first motor 121 to set the separation roller 114, the medium conveying apparatus can shut off electric power supply to the first motor 121, enabling reduction in power consumption.

As described above in detail, the medium conveying apparatus including the driving force transmitting mechanism 230 with the torque limiter 235 can also keep pressing the separation roller 114 toward the feed roller 113 with appropriate force while reducing power consumption.

Figure 14:
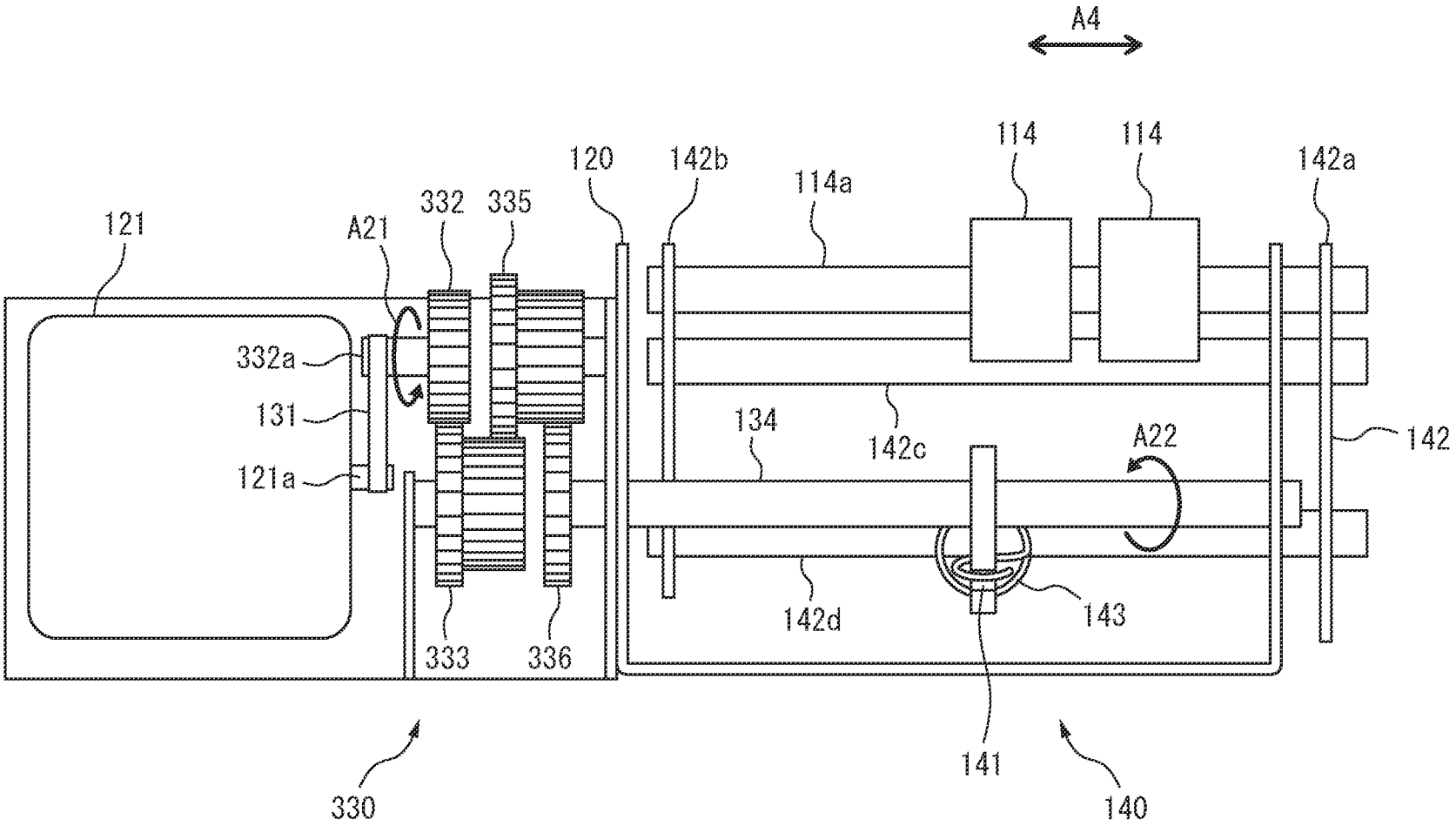
FIG. 14 is a schematic diagram for explaining a driving force transmitting mechanism 330.

FIG. 14 is a schematic diagram for explaining another driving force transmitting mechanism 330. FIG. 14 is a schematic diagram of the driving force transmitting mechanism 330 and the pressing mechanism 140 viewed from upstream.

The driving force transmitting mechanism 330, which is used instead of the driving force transmitting mechanism 130, has a structure and a mechanism similar to those of the driving force transmitting mechanism 130. However, the driving force transmitting mechanism 330 does not include the worm 132 nor the worm wheel 133, and instead includes a first gear 332, a first reduction gear 333, a second reduction gear 335, and a second gear 336.

The belt 131 is wound around the rotating shaft 121*a* of the first motor 121 and a first gear shaft 332*a*, which is the rotating shaft of the first gear 332. The first gear 332 meshes with the larger gear of the first reduction gear 333, the smaller gear of the first reduction gear 333 meshes with the larger gear of the second reduction gear 335, and the smaller gear of the second reduction gear 335 meshes with the second gear 336. The second gear 336 is attached to the cam member shaft 134.

The first reduction gear 333 and the second reduction gear 335 rotate along with the first motor 121 to rotate the second gear 336, the cam member shaft 134, and the cam member 141. The reduction ratios of the first reduction gear 333 and the second reduction gear 335 are set so as to prevent rotation of the second gear 336 when the cam member 141 attempts to rotate in the direction opposite to arrow A22 by the tensile force of the first elastic member 143 and the weight of the separation roller 114, This prevents the cam member 141 from being rotated by the tensile force of the first elastic member 143 and the weight of the separation roller 114.

More specifically, the first reduction gear 333 and the second reduction gear 335 transmit driving force generated by the first motor 121 from the first motor 121 to the cam member 141, rotating the cam member 141 to press the separation roller 114 toward the feed roller 113. The first reduction gear 333 and the second reduction gear 335 are provided so that the cam member 141 keeps pressing the separation roller 114 toward the feed roller 113 without rotating the cam member 141 in the direction opposite to arrow A22 even if electric power supply to the first motor 121 is shut off. Thus, after controlling the first motor 121 to set the separation roller 114, the medium conveying apparatus can shut off electric power supply to the first motor 121, enabling reduction in power consumption. The number of reduction gears is not limited to two, and may be one or three or more.

As described above in detail, the medium conveying apparatus including the driving force transmitting mechanism 330 with the first reduction gear 333 and the second reduction gear 335 can also keep pressing the separation roller 114 toward the feed roller 113 with appropriate force while reducing power consumption.

Figure 15:
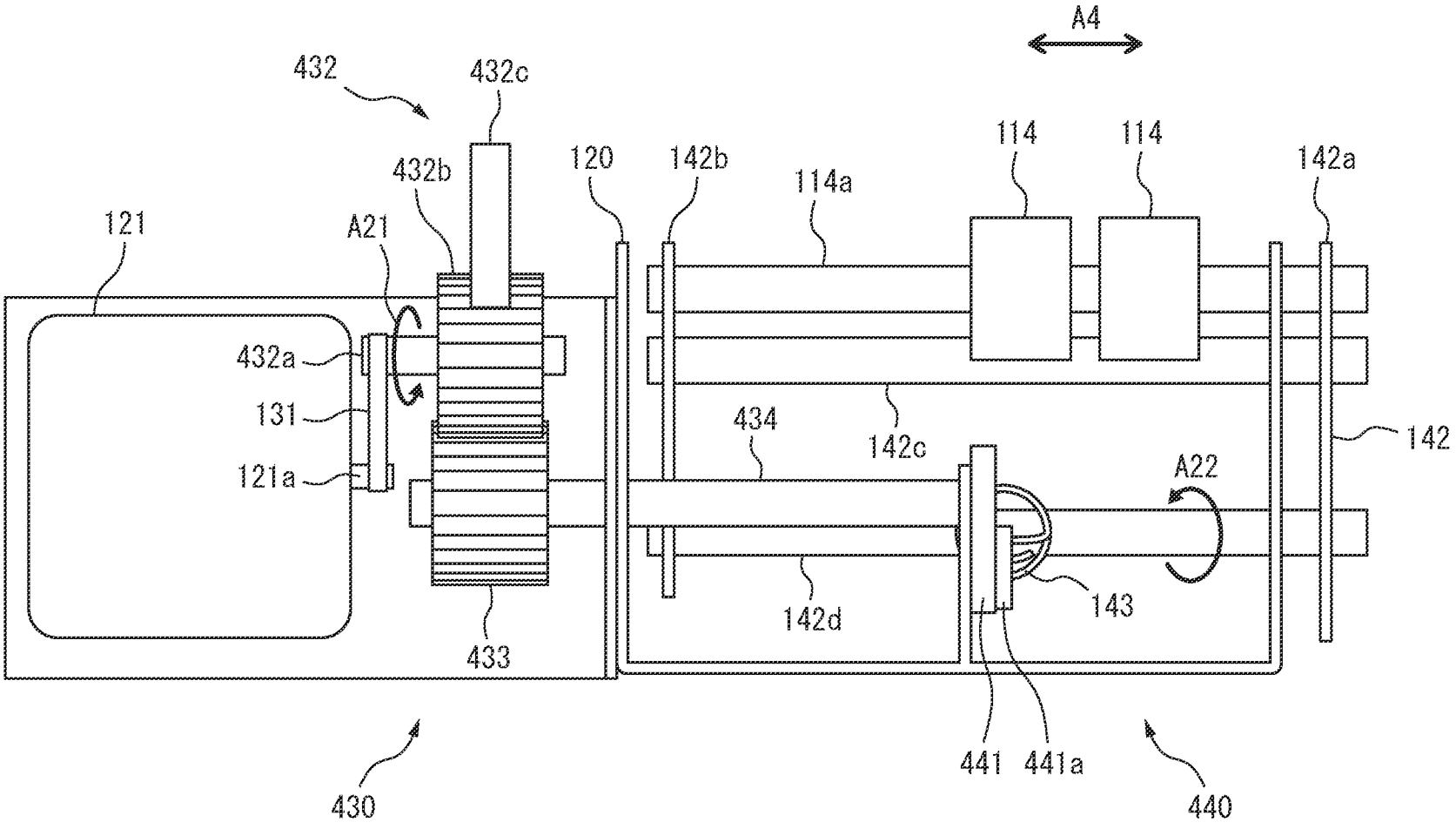
FIG. 15 is a schematic diagram for explaining a driving force transmitting mechanism 430 and other components.

FIG. 15 is a schematic diagram for explaining still another driving force transmitting mechanism 430 and a pressing mechanism 440. FIG. 15 is a schematic diagram of the driving force transmitting mechanism 430 and the pressing mechanism 440 viewed from upstream.

The driving force transmitting mechanism 430, which is used instead of the driving force transmitting mechanism 130, has a structure and a mechanism similar to those of the driving force transmitting mechanism 130. However, the driving force transmitting mechanism 430 does not include the worm 132 nor the worm wheel 133, and instead includes a ratchet gear 432 and a gear 433. The driving force transmitting mechanism 430 also includes a cam member shaft 434 instead of the cam member shaft 134.

The belt 131 is wound around the rotating shaft 121*a* of the first motor 121 and a ratchet gear shaft 432*a*, which is the rotating shaft of the ratchet gear 432. The ratchet gear 432 meshes with the gear 433. The gear 433 is attached to the cam member shaft 434. The cam member shaft 434 is provided so as not to project opposite to the ratchet gear 432 from a cam member 441 included in the pressing mechanism 440.

Figure 16A:
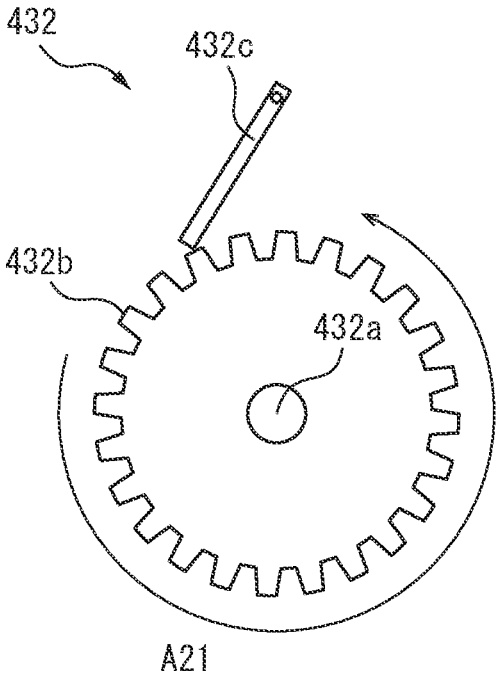
FIG. 16A is a schematic diagram for explaining a ratchet gear 432.
Figure 16B:
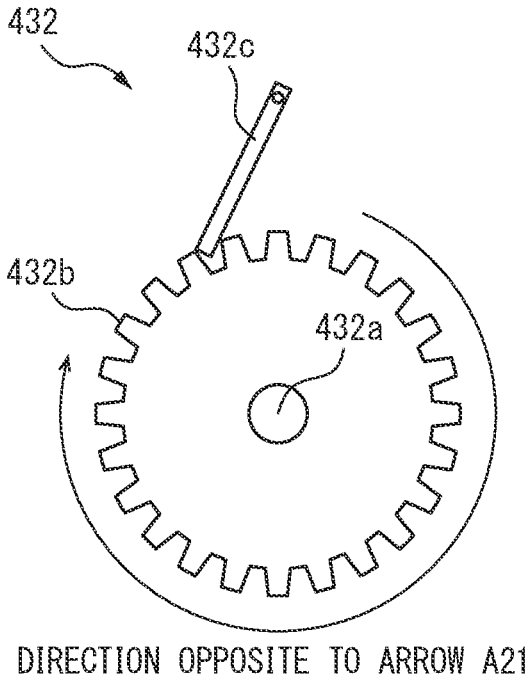
FIG. 16B is a schematic diagram for explaining the ratchet gear 432.

FIGS. 16A and 16B are schematic diagrams for explaining the ratchet gear 432.

As shown in FIGS. 16A and 16B, the ratchet gear 432 includes a gear portion 432*b* and a pawl 432*c*. The pawl 432*c* is provided to face the gear portion 432*b* so that it may allow rotation of the gear portion 432*b* in the direction of arrow A21 and restrict rotation thereof in the direction opposite to arrow A21. This allows the ratchet gear 432 to rotate only in the direction of arrow A21, and the gear 433 and the cam member shaft 434 to rotate only in the direction of arrow A22. Thus, rotation of the cam member 141 by the tensile force of the first elastic member 143 and the weight of the separation roller 114 is prevented.

Figure 17:
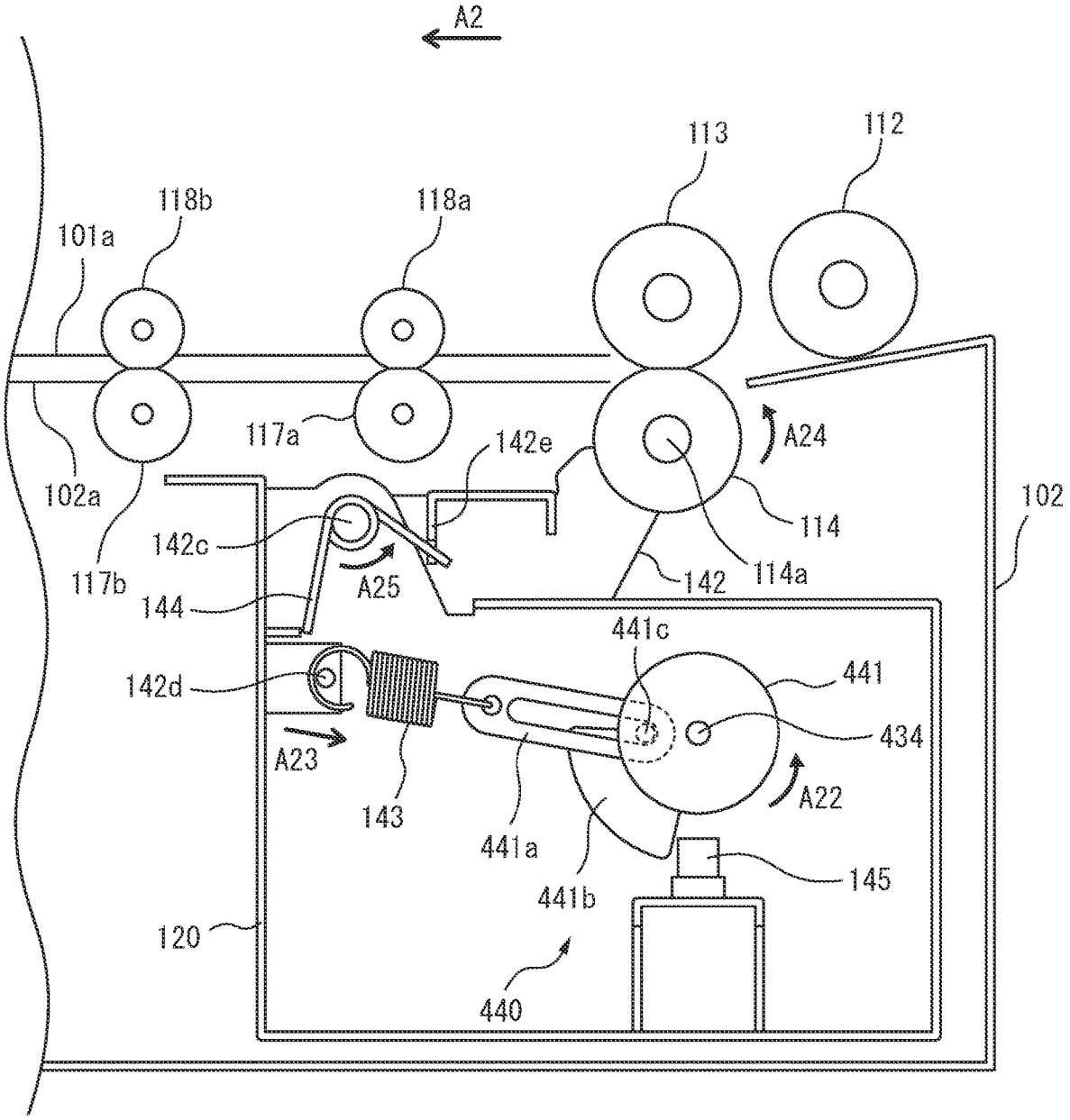
FIG. 17 is a schematic diagram for explaining a pressing mechanism 440.
Figure 18:
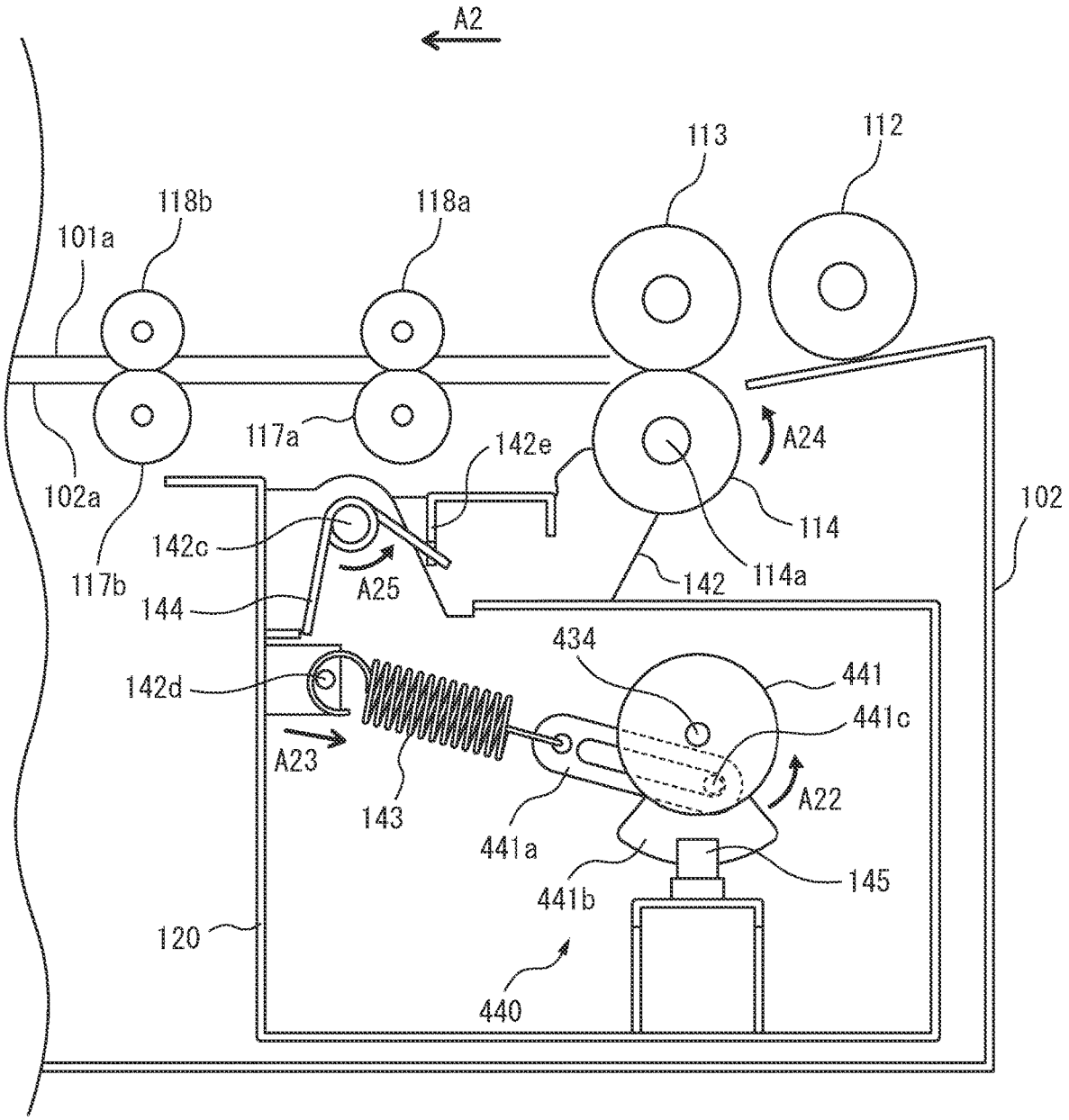
FIG. 18 is a schematic diagram for explaining the pressing mechanism 440.

FIGS. 17 and 18 are schematic diagrams for explaining the pressing mechanism 440. FIGS. 17 and 18 are side views of the pressing mechanism 440.

The pressing mechanism 440, which is used instead of the pressing mechanism 140, has a structure and a mechanism similar to those of the pressing mechanism 140. However, the pressing mechanism 440 includes a cam member 441 instead of the cam member 141.

The cam member 441 is attached to the cam member shaft 434 so as to be rotated (swung) by rotation of the cam member shaft 434. The cam member 441 is provided with an engaging portion 441*a* and a detection target portion 441*b*. One end of the engaging portion 441*a* engages with a projection 441*c* provided on the surface of the cam member 441 opposite to the ratchet gear 432, and the other end of the engaging portion 441*a* is attached to the first elastic member 143. Thus, the projection 441*c* moves by rotation of the cam member 441, and the engaging portion 441*a* moves along with the projection 441*c*. The detection target portion 441*b* is a plate-like member similar to the detection target portion 141*b*, and rotates (swings) along with the cam member 441.

As shown in FIG. 1:5, when the first motor 121 is supplied with electric power to rotate in the direction of arrow A21, the belt 131 and the ratchet gear 432 rotate in the direction of arrow A21. Along with the ratchet gear 432, the gear 433 rotates in the direction of arrow A22, causing the cam member 441 to rotate in the direction of arrow A22 via the cam member shaft 434. As shown in FIGS. 17 and 18, rotation of the cam member 441 in the direction of arrow A22 moves the projection 441*c* away from the first engaging member 142*d*, causing the engaging portion 441*a* to stretch the first elastic member 143 in the direction of arrow A23 (to the upstream side). In this way, the separation roller 114 is pressed toward the feed roller 113.

Further rotation of the first motor 121 in the direction of arrow A21 further rotates the cam member 441 in the direction of arrow A22, causing the projection 441*c* to approach the first engaging member 142*d*. This reduces the force in the direction of arrow A23 applied by the engaging portion 441*a* to the first elastic member 143. This reduces the force to press the feed roller 113 applied to the separation roller 114.

As shown in FIG. 18, the cam member 441 stretches the first elastic member 143 in the direction of arrow A23, conversely, to the cam member 441 and the cam member shaft 434, the first engaging member 142*d* applies force in the direction opposite to arrow A23. However, the ratchet gear 432 prevents the cam member shaft 434 from rotating in the direction opposite to arrow A22, as described above. Thus, the cam member 441 keeps pressing the separation roller 114 toward the feed roller 113 without rotating in the direction opposite to arrow A22 even if electric power supply to the first motor 121 is shut off.

When the pressing mechanism 440 is used, the measurement module 171 or the control module 173 rotates the cam member 441 only in one direction (the direction of arrow A22) to move the cam member 441 in step S102 of FIG. 11 and steps S203 and S211 of FIG. 12.

In this way, the ratchet gear 432 transmits driving force generated by the first motor 121 from the first motor 121 to the cam member 441, rotating the cam member 441 to press the separation roller 114 toward the feed roller 113. The ratchet gear 432 is provided so that the cam member 441 keeps pressing the separation roller 114 toward the feed roller 113 without rotating the cam member 441 in the direction opposite to arrow A22 even if electric power supply to the first motor 121 is shut off. Thus, after controlling the first motor 121 to set the separation roller 114, the medium conveying apparatus can shut off electric power supply to the first motor 121, enabling reduction in power consumption.

As described above in detail, the medium conveying apparatus including the driving force transmitting mechanism 430 with the ratchet gear 432 can also keep pressing the separation roller 114 pressed toward the feed roller 113 with appropriate force while reducing power consumption.

Figure 19:
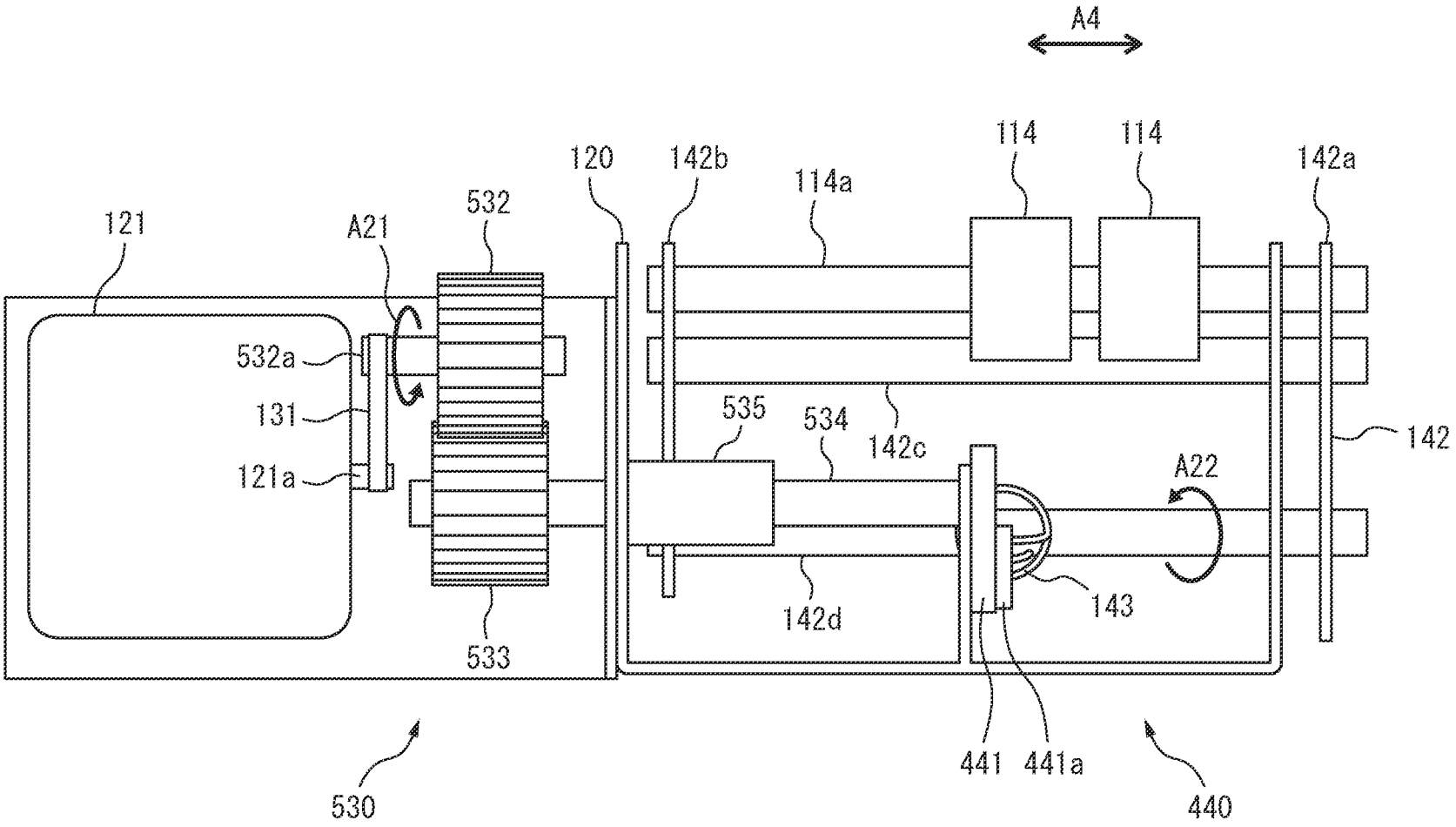
FIG. 19 is a schematic diagram for explaining a driving force transmitting mechanism 530 and other components.

FIG. 19 is a schematic diagram for explaining yet another driving force transmitting mechanism 530 and the pressing mechanism 440. FIG. 19 is a schematic diagram of the driving force transmitting mechanism 530 and the pressing mechanism 440 viewed from upstream.

The driving force transmitting mechanism 530, which is used instead of the driving force transmitting mechanism 130, has a structure and a mechanism similar to those of the driving force transmitting mechanism 130. However, the driving force transmitting mechanism 530 does not include the worm 132 nor the worm wheel 133, and instead includes a first gear 532, a second gear 533, and a one-way clutch 535. The driving force transmitting mechanism 530 also includes a cam member shaft 534 instead of the cam member shaft 134. When the driving force transmitting mechanism 530 is used, the pressing mechanism 440 is used instead of the pressing mechanism 140.

The belt 131 is wound around the rotating shaft 121*a* of the first motor 121 and a first gear shaft 532*a*, which is the rotating shaft of the first gear 532. The first gear 532 is provided to mesh with the second gear 533. The second gear 533 is attached to the cam member shaft 534, The cam member shaft 534 is provided so as not to project opposite to the second gear 533 from the cam member 441 included in the pressing mechanism 440, similarly to the cam member shaft 434.

The one-way clutch 535 is provided on the cam member shaft 534 to allow rotation of the cam member shaft 534 in the direction of arrow A22 and restrict rotation thereof in the direction opposite to arrow A22, This prevents the cam member 441 from being rotated by the tensile force of the first elastic member 143 and the weight of the separation roller 114.

In this way, the one-way clutch 535 transmits driving force generated by the first motor 121 from the first motor 121 to the cam member 441, rotating the cam member 441 to press the separation roller 114 toward the feed roller 113, The one-way clutch 535 is provided so that the cam member 441 keeps pressing the separation roller 114 toward the feed roller 113 without rotating the cam member 441 in the direction opposite to arrow A22 even if electric power supply to the first motor 121 is shut off. Thus, after controlling the first motor 121 to set the separation roller 114, the medium conveying apparatus can shut off electric power supply to the first motor 121, enabling reduction in power consumption.

As described above in detail, the medium conveying apparatus including the driving force transmitting mechanism 530 with the one-way clutch 535 can also keep pressing the separation roller 114 toward the feed roller 113 with appropriate force while reducing power consumption.

Figure 20:
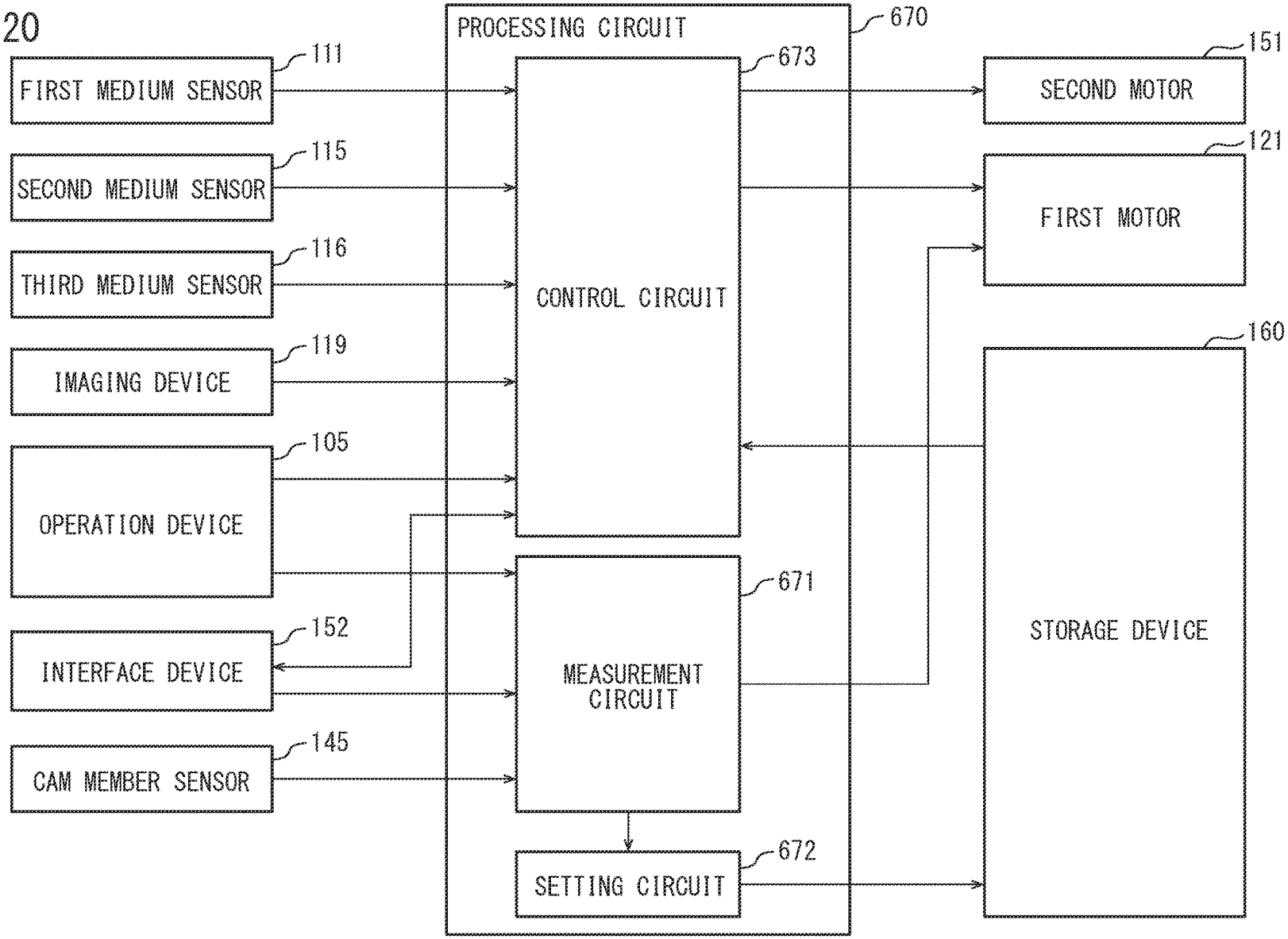
FIG. 20 schematically shows the configuration of a processing circuit 670 according to another embodiment.

FIG. 20 schematically shows the configuration of a processing circuit 670 of a medium conveying apparatus according to another embodiment.

The processing circuit 670 is used instead of the processing circuit 170 of the medium conveying apparatus 100, and executes the setting process, the medium reading process, and other processes instead of the processing circuit 170. The processing circuit 670 includes a measurement circuit 671, a setting circuit 672, and a control circuit 673, These circuits may be configured by separate integrated circuits, microprocessors, or firmware.

The measurement circuit 671, which is an example of a measurement module, has a function similar to that of the measurement module 171. When receiving an adjustment signal from the operation device 105 or the interface device 152, the measurement circuit 671 controls the first motor 121 and receives a cam member signal from the cam member sensor 145, and measures the amount of rotation of the cam member 141, based on the received cam member signal. The measurement circuit 671 outputs the result of measurement to the setting circuit 672.

The setting circuit 672, which is an example of a setting module, has a function similar to that of the setting module 172. The setting circuit 672 receives the result of measurement of the amount of rotation of the cam member 141 from the measurement circuit 671, and sets a default value in the storage device 160, based on the received result of measurement.

The control circuit 673, which is an example of a control module, has a function similar to that of the control module 173, The control circuit 673 reads the default value from the storage device 160, and controls the first motor 121, based on the read default value. In addition, the control circuit 673 receives an operation signal from the operation device 105 or the interface device 152, and receives first, second, and third medium signals from the first, second, and third medium sensors 111, 115, and 116, respectively. The control circuit 673 controls the second motor 151, based on the received signals, acquires an input image from the imaging device 119, and outputs it to the interface device 152.

As described above in detail, the medium conveying apparatus including the processing circuit 670 to execute the setting process and the medium reading process can also keep pressing the separation roller 114 toward the feed roller 113 with appropriate force while reducing power consumption.

According to the embodiment, the medium conveying apparatus can keep pressing the separation roller toward the feed roller with appropriate force while reducing power consumption.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiment(s) of the present inventions have been described in detail, it should be understood that the various changes, substitutions, and alterations could be made hereto without departing from the spirit and scope of the invention,

What is claimed is:

1. A medium conveying apparatus comprising:
- a feed roller to feed a medium;
- a separation roller opposed to the feed roller;
- a motor to generate a driving force by being supplied with an electric power;
- a cam member rotated in a first direction by the driving force to press the separation roller toward the feed roller and change a force with which the separation roller separates the medium; and
- a driving force transmitting mechanism between the motor and the cam member configured to transmit the driving force from the motor to the cam member and provided such that the cam member keeps pressing the separation roller toward the feed roller without rotating the cam member in a second direction opposite to the first direction when the electric power supplied to the motor is shut off.

2. The medium conveying apparatus according to claim 1, wherein the driving force transmitting mechanism includes a worm gear including a worm and a worm wheel.

3. The medium conveying apparatus according to claim 1, wherein the driving force transmitting mechanism includes a torque limiter.

4. The medium conveying apparatus according to claim 1, wherein the driving force transmitting mechanism includes a reduction gear.

5. The medium conveying apparatus according to claim 1, wherein the driving force transmitting mechanism includes a ratchet gear.

6. The medium conveying apparatus according to claim 1, wherein the driving force transmitting mechanism includes a one-way clutch.

7. The medium conveying apparatus according to claim 1, further comprising:
- a support to support the separation roller;
- a first elastic member with one end attached to the cam member and the other end attached to the support; and
- a second elastic member with one end fixed and the other end attached to the support.

8. The medium conveying apparatus according to claim 1, further comprising a processor to
- measure the amount of rotation of the cam member, and
- set a value based on the amount of rotation measured when setting of the position of the cam member by an operator is accepted.

9. A medium conveying apparatus comprising:
- a feed roller to feed a medium;
- a separation roller opposed to the feed roller;
- a motor to generate a driving force by being supplied with electric power;
- a cam member rotated in a first direction by the driving force to press the separation roller toward the feed roller and change a force with which the separation roller separates the medium; and
- a gear, a shaft or a belt, between the motor and the cam member configured to transmit the driving force from the motor to the cam member and provided such that the cam member keeps pressing the separation roller toward the feed roller without rotating the cam member in a second direction opposite to the first direction when the electric power supplied to the motor is shut off.

* * * * *